US011499762B2

(12) United States Patent
Inoue et al.

(10) Patent No.: US 11,499,762 B2
(45) Date of Patent: Nov. 15, 2022

(54) HEAT EXCHANGER AND AIR CONDITIONER

(71) Applicant: DAIKIN INDUSTRIES, LTD., Osaka (JP)

(72) Inventors: Satoshi Inoue, Osaka (JP); Tomoki Hirokawa, Osaka (JP); Shun Yoshioka, Osaka (JP); Yoshiyuki Matsumoto, Osaka (JP); Shouta Agou, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 124 days.

(21) Appl. No.: 16/963,015

(22) PCT Filed: Dec. 25, 2018

(86) PCT No.: PCT/JP2018/047572
§ 371 (c)(1),
(2) Date: Jul. 17, 2020

(87) PCT Pub. No.: WO2019/142617
PCT Pub. Date: Jul. 25, 2019

(65) Prior Publication Data

US 2020/0355411 A1 Nov. 12, 2020

(30) Foreign Application Priority Data

Jan. 19, 2018 (JP) ..... JP2018-007622

(51) Int. Cl.
*F25B 39/00* (2006.01)
*F25B 39/02* (2006.01)
(Continued)

(52) U.S. Cl.
CPC ..... *F25B 39/028* (2013.01); *F28D 1/05391* (2013.01); *F28F 9/02* (2013.01);
(Continued)

(58) Field of Classification Search
CPC ..... F25B 39/028; F25B 39/02; F25B 39/04; F28F 9/02; F28F 1/128; F28F 2009/0285;
(Continued)

(56) References Cited

U.S. PATENT DOCUMENTS

2006/0054310 A1* 3/2006 Kim ..... F25B 39/02 165/110
2012/0073786 A1 3/2012 Sakashita et al.
(Continued)

FOREIGN PATENT DOCUMENTS

EP 1640682 A1 3/2006
JP S50-98366 U 8/1975
(Continued)

OTHER PUBLICATIONS

International Search Report issued in corresponding International Application No. PCT/JP2018/047572 dated Feb. 26, 2019 (5 pages).
(Continued)

*Primary Examiner* — Harry E Arant
(74) *Attorney, Agent, or Firm* — Osha Bergman Watanabe & Burton LLP

(57) ABSTRACT

A heat exchanger exchanges heat between refrigerant flowing inside and air flowing outside. The heat exchanger includes: an upstream-side flat tube; downstream-side flat tubes on a downstream side of the upstream-side flat tube in a direction of air flow; and a space formation member that defines a distribution space in which the refrigerant coming out of the upstream-side flat tube is distributed to the downstream-side flat tubes.

8 Claims, 18 Drawing Sheets

(51) Int. Cl.
*F28D 1/053* (2006.01)
*F28F 9/02* (2006.01)
*F28D 21/00* (2006.01)

(52) U.S. Cl.
CPC ..... *F28D 2021/0071* (2013.01); *F28F 2009/0285* (2013.01)

(58) Field of Classification Search
CPC ..... F28F 9/0209; F28D 1/05391; F28D 2021/0071; F28D 1/0471; F28D 1/05333; F28D 1/05383; F28D 1/05325
See application file for complete search history.

(56) References Cited

U.S. PATENT DOCUMENTS

| | | | | |
|---|---|---|---|---|
| 2013/0199288 | A1* | 8/2013 | Goenka ..... | F28D 1/05383 73/202 |
| 2016/0169586 | A1* | 6/2016 | Ito ..... | F28D 1/05391 165/104.21 |

FOREIGN PATENT DOCUMENTS

| | | | | | |
|---|---|---|---|---|---|
| JP | S54-28160 | U | | 2/1979 | |
| JP | S63-197893 | A | | 8/1988 | |
| JP | S63197893 | A | * | 8/1988 | ..... F28D 1/053 |
| JP | 2003-166797 | A | | 6/2003 | |
| JP | 2005-133977 | A | | 5/2005 | |
| WO | 2010/146852 | A1 | | 12/2010 | |

OTHER PUBLICATIONS

International Preliminary Report on Patentability issued in corresponding International Application No. PCT/JP2018/047572 dated Jul. 21, 2020 (10 pages).

Extended European Search Report issued in corresponding European Patent Application No. 18901332.9, dated Sep. 3, 2021 (7 pages).

* cited by examiner

HEAT EXCHANGER AND AIR CONDITIONER

TECHNICAL FIELD

The present invention relates to a heat exchanger and an air conditioner.

BACKGROUND

A known heat exchanger such as a heat exchanger disclosed in, for example, PTL 1 (International Publication No. 2010/146852) includes heat transfer tubes arranged in three columns adjacent to each other in the direction of air flow and connection pipes each of which branches to form a connection between a heat transfer tube in a column and a heat transfer tube in another column.

The heat exchanger includes cylindrical heat transfer tubes to allow passage of refrigerant. However, no mention is made of how to distribute refrigerant among columns of heat transfer tubes in a heat exchanger in which flat tubes having a flat shape are used as heat transfer tubes.

SUMMARY

The present invention therefore has been made in view of such circumstances, and one or more embodiments of the present invention provide a heat exchanger and an air conditioner in which flat tubes having a flat shape may be used as heat transfer tubes in a manner so as to distribute flows of refrigerant appropriately.

A heat exchanger according to a first aspect is a heat exchanger in which heat is exchanged between refrigerant flowing inside and air flowing outside. The heat exchanger includes at least one upstream-side flat tube, at least two downstream-side flat tubes on a downstream side of the upstream-side flat tube in a direction of air flow, and a space formation member. The space formation member defines distribution space in which the refrigerant coming out of the upstream-side flat tube is distributed to the at least two downstream-side flat tubes.

A feature of the heat exchanger is that the refrigerant coming out of the upstream-side flat tube may be distributed to the downstream-side flat tubes through the distribution space defined by the space formation member. Owing to this feature, flat tubes having a flat shape may be used as heat transfer tubes of the heat exchanger in a manner so as to distribute the refrigerant appropriately.

A heat exchanger according a second aspect is the heat exchanger according to the first aspect, wherein the distribution space is configured to turn back the refrigerant coming out of the upstream-side flat tube and lead to the downstream-side flat tubes.

With the heat exchanger being configured as described above, the refrigerant through the upstream-side flat tube may turn back and may be led to the downstream-side flat tubes when reaching the distribution space.

A heat exchanger according to a third aspect is the heat exchanger according to the first or second aspect and further includes a header. In the header, the distribution space is defined. The space formation member is part of the header. The upstream-side flat tube and the downstream-side flat tubes are connected to the header.

A feature of the heat exchanger is that the upstream-side flat tube and the downstream-side flat tubes are connected to the header in which the distribution space is provided, with the space formation member being part of the header. Owing to this feature, the refrigerant coming out of the upstream-side flat tube may be appropriately distributed to the downstream-side flat tubes.

A heat exchanger according to a fourth aspect is the heat exchanger according to any one of the first to third aspects and is configured to include a portion in which the flat tubes connected to the distribution space do not overlap each other when viewed in the direction of air flow.

The flat tubes may include the upstream-side flat tube and the downstream-side flat tubes.

A feature of the heat exchanger is that the heat exchanger includes a portion in which flat tubes connected to the distribution space do not overlap each other when viewed in the direction of air flow. Owing to this feature, the flat tubes in the relevant part of the heat exchanger may be sufficiently exposed to air.

A heat exchanger according to a fifth aspect is the heat exchanger according to any one of the first to fourth aspects and is configured as follows: the downstream-side flat tubes include at least one first downstream-side flat tube and at least one second downstream-side flat tube on a downstream side of the first downstream-side flat tube in the direction of air flow.

With the heat exchanger being configured as described above, the refrigerant may be appropriately distributed to the first downstream-side flat tube and the second downstream-side flat tube that are in different columns adjacent to each other in the direction of air flow.

A heat exchanger according to a sixth aspect is the heat exchanger according to the fifth aspect, wherein a first communicating channel and a second communicating channel are provided in the distribution space to lead the refrigerant coming out of the upstream-side flat tube to the first downstream-side flat tube and the second downstream-side flat tube, respectively. A flow path defined by the first communicating channel is wider than a flow path defined by the second communicating channel.

A feature of the heat exchanger is that the flow path defined by the first communicating channel that leads the refrigerant coming out of the upstream-side flat tube to the first downstream-side flat tube is wider than the flow path defined by the second communication channel that leads the refrigerant coming out of the upstream-side flat tube to the second downstream-side flat tube. Owing to this feature, the refrigerant coming out of the upstream-side flat tube tends to be led to the first downstream-side flat tube.

A heat exchanger according to a seventh aspect is the heat exchanger according to the fifth aspect, wherein a first communicating channel and a second communicating channel are provided in the distribution space to lead the refrigerant coming out of the upstream-side flat tube to the first downstream-side flat tube and the second downstream-side flat tube, respectively. An inlet of the first communicating channel is located at a position lower in a direction of gravity than an inlet of the second communicating channel.

A feature of the heat exchanger is that the inlet of the first communicating channel that leads the refrigerant coming out of the upstream-side flat tube to the first downstream-side flat tube is located at a position lower than the inlet of the second communication channel that leads the refrigerant coming out of the upstream-side flat tube to the second downstream-side flat tube. Owing to this feature, the gas-liquid two-phase refrigerant coming out of the upstream-side flat tube tends to be led to the first downstream-side flat tube.

A heat exchanger according to an eighth aspect is the heat exchanger according to any one of the fifth to seventh aspects, wherein the distribution space is connected with the second downstream-side flat tube and the first downstream-side flat tube located at a position lower in a direction of gravity than the second downstream-side flat tube.

The distribution space may be formed in such a manner that an upper end and a lower end thereof extend in their respective height positions in the direction of air flow.

A feature of the heat exchanger is that the first downstream-side flat tube is in a height position lower than the height position of the second downstream-side flat tube and is disposed on an upstream side in the direction of air flow. Owing to this feature, the gas-liquid two-phase refrigerant coming out of the upstream-side flat tube tends to be led to the first downstream-side flat tube.

A heat exchanger according to a ninth aspect is the heat exchanger according to any one of the fifth to eighth aspects, wherein the at least one upstream-side flat tube includes a plurality of upstream-side flat tubes arranged in such a manner that flat portions of each upstream-side flat tubes face each other. The at least one first downstream-side flat tube includes a plurality of first downstream-side flat tubes arranged in such a manner that flat portions of each first downstream-side flat tubes face each other. The at least one second downstream-side flat tube includes a plurality of second downstream-side flat tubes arranged in such a manner that flat portions of each second downstream-side flat tubes face each other. The at least one distribution space includes a plurality of distribution spaces arranged in a manner so that the distribution spaces are aligned to each other in a direction in which the upstream-side flat tubes are aligned to each other.

A feature of the heat exchanger is that the plurality of distribution spaces are arranged in a manner so that the distribution spaces are aligned to each other in a direction in which the upstream-side flat tubes are aligned to each other. In each distribution space, the refrigerant coming out of the upstream-side flat tube may thus be appropriately distributed to the downstream-side flat tube.

A heat exchanger according to a tenth aspect is the heat exchanger according to any one of the fifth to ninth aspects and is configured as follows. The upstream-side flat tube includes a plurality of upstream-side flat tubes including a first upstream-side flat tube and a second upstream-side flat tube that are arranged in such a manner that flat portions of the first and second upstream-side flat tubes face each other. The distribution space includes a first distribution space provided to lead the refrigerant coming out of the first upstream-side flat tube to the downstream-side flat tubes and a second distribution space provided to lead the refrigerant coming out of the second upstream-side flat tube to the downstream-side flat tubes independently of the first distribution space. In part of the distribution space, the number of the first downstream-side flat tubes connected to the first distribution space is greater than the number of the first downstream-side flat tubes connected to the second distribution space.

The portion in which the number of the first downstream-side flat tubes connected to the first distribution space is greater than the number of the first downstream-side flat tubes connected to the second distribution space may be part of the heat exchanger.

The speed of air flow supplied to the heat exchanger is not constant across the heat exchanger, in which wind speed distribution is found. This may improve the performance of the heat exchanger in use environments where the speed of air flow passing by the first upstream-side flat tube is lower than the speed of air flow passing by the second upstream-side flat tube.

An air conditioner according to an eleventh aspect includes the heat exchanger according to any one the first to tenth aspects and a fan that supplies air flow to the heat exchanger.

Flat tubes having a flat shape may be used as heat transfer tubes of the air conditioner in such a manner that the refrigerant coming out of the upstream-side flat tube is appropriately distributed to the downstream-side flat tubes on a downstream side in the direction of air flow created by the fan.

DETAILED DESCRIPTION (1) Configuration of Air Conditioner

Figure 1:
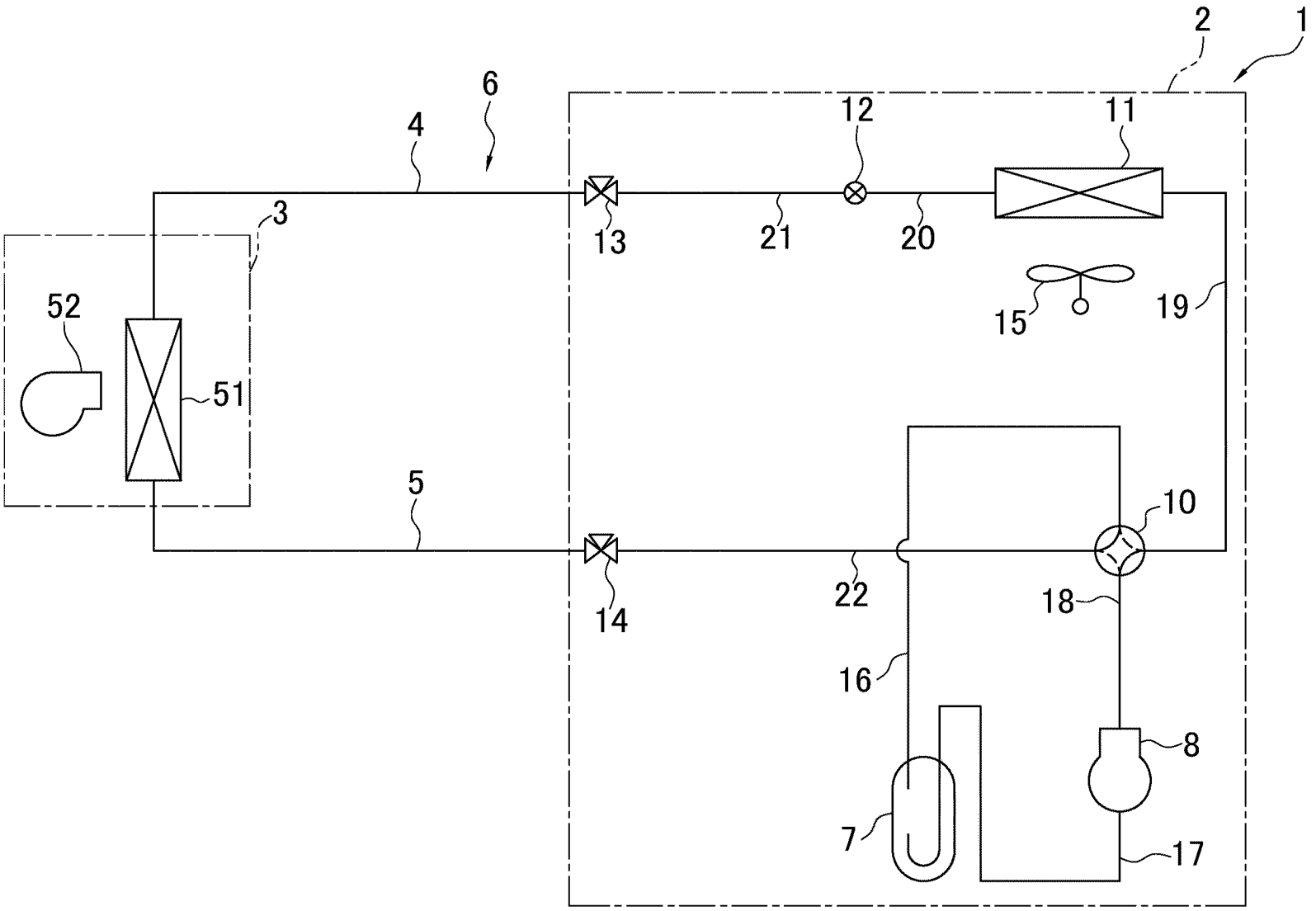
FIG. 1 is a schematic configuration diagram of an air conditioner.

FIG. 1 is a schematic configuration diagram of an air conditioner 1.

The air conditioner 1 is an apparatus capable of cooling or heating a room in a building or the like through a vapor compression refrigeration cycle.

The air conditioner 1 includes mainly an outdoor unit 2, an indoor unit 3, a liquid-refrigerant connection pipe 4, and a gas-refrigerant connection pipe 5. These refrigerant connection pipes are refrigerant paths connecting the outdoor unit 2 to the indoor unit 3. The outdoor unit 2, the indoor unit 3, and the refrigerant connection pipes 4 and 5 forming connections between these units constitute a vapor compression refrigerant circuit 6 of the air conditioner 1. The refrigerant connection pipes 4 and 5 are refrigerant pipes that are to be laid on-site when the air conditioner 1 is installed on an installation site such as a building. The refrigerant circuit 6 is charged with a working refrigerant, which is R32 in one or more embodiments but is not limited to R32.

(2) Outdoor Unit (2-1) Schematic Configuration of Outdoor Unit

The outdoor unit 2 is installed outdoors (on a rooftop of a building or adjacent to the surface of a wall of a building) and is part of the refrigerant circuit 6. The outdoor unit 2 includes mainly an accumulator 7, a compressor 8, a four-way switching valve 10, an outdoor heat exchanger 11, an outdoor expansion valve 12 (i.e., an expansion mechanism), a liquid-side shutoff valve 13, a gas-side shutoff valve 14, an outdoor fan 15, and a casing 40.

The accumulator 7 is a container for supplying gas refrigerant to a compressor and is provided on the intake side of the compressor 8.

The compressor 8 sucks in low-pressure gas refrigerant, compresses the refrigerant to transform it into high-pressure gas refrigerant, and then discharges the gas refrigerant.

The outdoor heat exchanger 11 is a heat exchanger that functions as a radiator for refrigerant discharged by the compressor 8 during cooling operation and functions as an evaporator for refrigerant transmitted from an indoor heat exchanger 51 during heating operation. The liquid side of the outdoor heat exchanger 11 is connected to the outdoor expansion valve 12, and the gas side of the outdoor heat exchanger 11 is connected to the four-way switching valve 10.

The outdoor expansion valve 12 is an electric expansion valve capable of decompressing refrigerant in the following manner: during the cooling operation, refrigerant having transferred heat in the outdoor heat exchanger 11 is decompressed before being transmitted to the indoor heat exchanger 51; and during heating operation, refrigerant having transferred heat in the indoor heat exchanger 51 is decompressed before being transmitted to the outdoor heat exchanger 11.

The liquid-side shutoff valve 13 of the outdoor unit 2 is connected with an end of the liquid-refrigerant connection pipe 4. The gas-side shutoff valve 14 of the outdoor unit 2 is connected with an end of the gas-refrigerant connection pipe 5.

Refrigerant pipes 16 to 22 form connections between the devices and valves included in the outdoor unit 2.

The four-way switching valve 10 switches between a connected state for the cooling operation and a connected state for the heating operation, which will be described later, by switching between the following states: the state in which the discharge side of the compressor 8 is connected to the outdoor heat exchanger 11 side and the intake side of the compressor 8 is connected to the gas-side shutoff valve 14 side (see solid lines in the four-way switching valve 10 illustrated in FIG. 1); and the state in which the discharge side of the compressor 8 is connected to the gas-side shutoff valve 14 side and the intake side of the compressor 8 is connected to the outdoor heat exchanger 11 side (see broken lines in the four-way switching valve 10 illustrated in FIG. 1).

The outdoor fan 15 is disposed inside the outdoor unit 2 and creates air flow (denoted by arrows in FIG. 3) by sucking in outdoor air, which is in turn supplied to the outdoor heat exchanger 11 and is then discharged out of the unit. In this way, the outdoor air supplied by the outdoor fan 15 is used as a cooling source or a heating source that exchanges heat with refrigerant in the outdoor heat exchanger 11.

Figure 2:
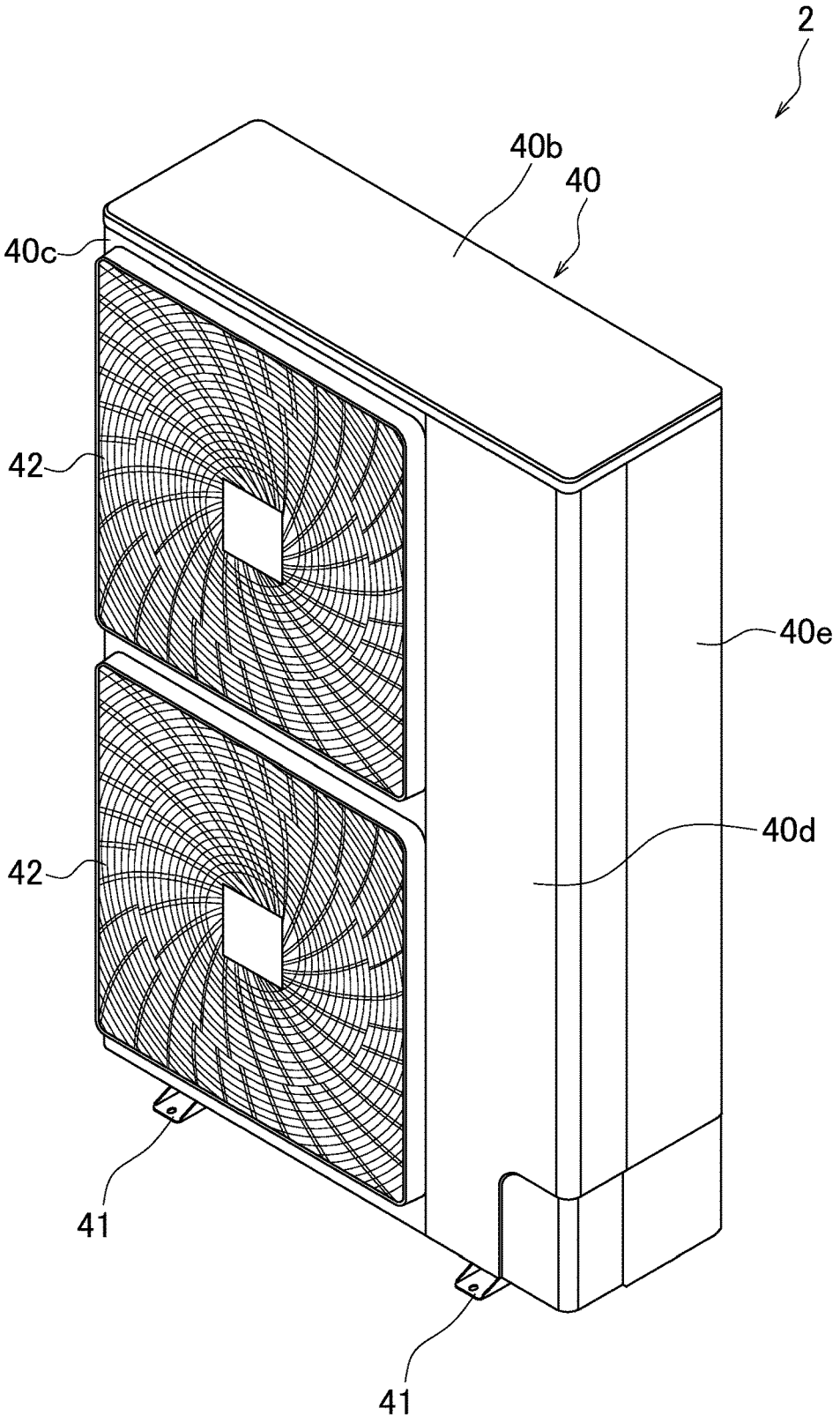
FIG. 2 is a schematic external perspective view of an outdoor unit.
Figure 3:
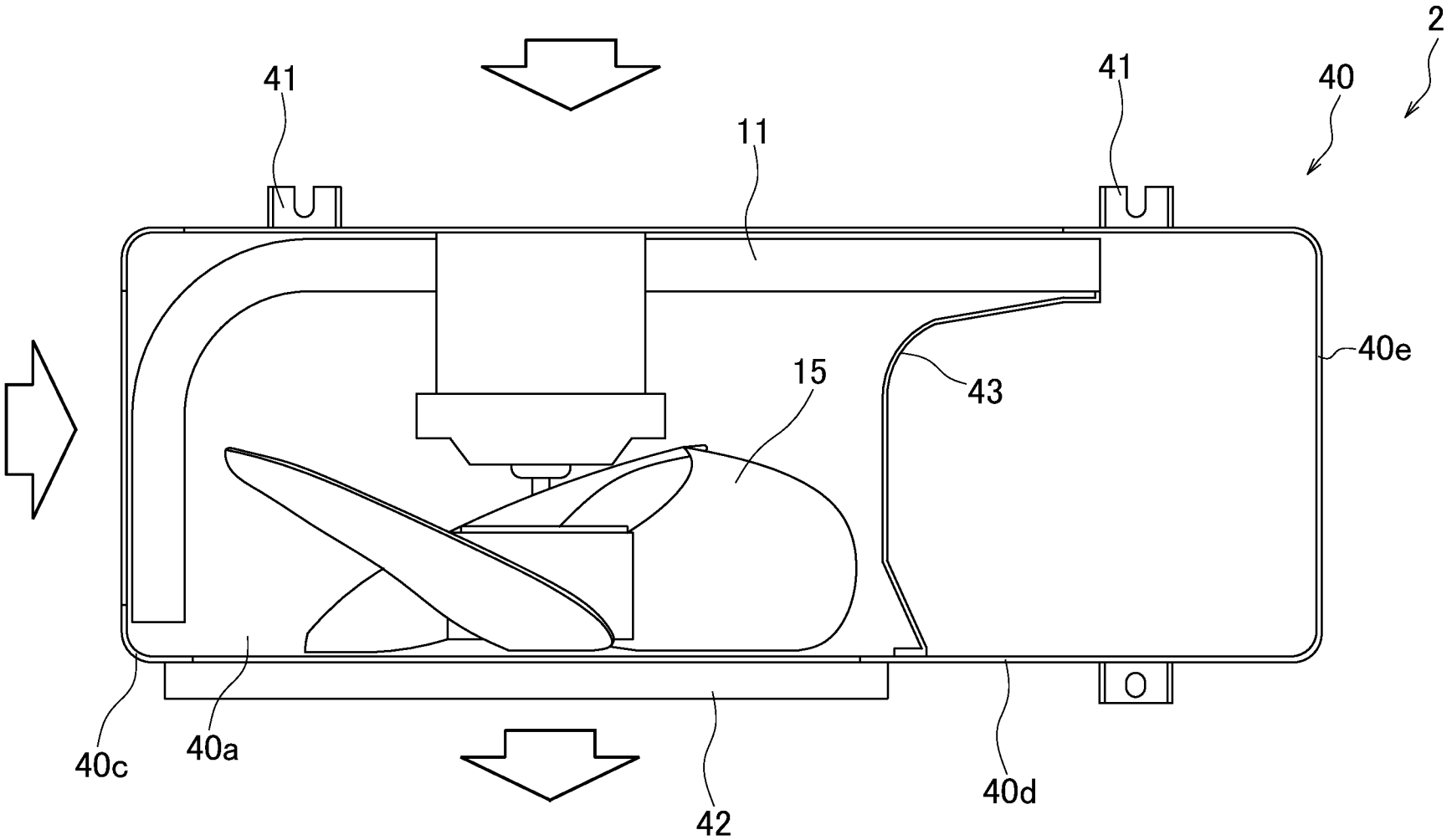
FIG. 3 is a schematic configuration diagram of the outdoor unit viewed in plan.

As illustrated in FIG. 2, which is a schematic external perspective view of the outdoor unit 2, and in FIG. 3, which is a schematic configuration diagram of the outdoor unit 2 viewed in plan, the casing 40 includes mainly a bottom frame 40*a*, a top panel 40*b*, a left-front panel 40*c*, a right-front panel 40*d*, and a right-side panel 40*e*. The bottom frame 40*a* is a plate-shaped member being a bottom face part of the casing 40 and having an oblong, substantially rectangular shape and is placed on an installation surface on-site via fixation legs 41 fixed to the underside. The top panel 40*b* is a plate-shaped member being a top face part of the casing 40 and having an oblong, substantially rectangular shape. The left-front panel 40*c* is a plate-shaped member being mainly a left front face part and a left side face part of the casing 40 and is provided with two blow-out openings adjacent to each other in up-and-down directions. Air drawn into the casing 40 by the outdoor fan 15 through a back face and a left side face is blown on a front face through the blow-out openings. Each blow-out opening is provided with a fan grille 42. The right-front panel 40*d* is a plate-shaped member being mainly a right front face part of the casing 40 and a front portion of a right side face of the casing 40. The right-side panel 40*e* is a plate-shaped member being mainly a rear portion of the right side face of the casing 40 and a right back face part of the casing 40.

The casing 40 is provided with a partition plate 43, which is a partition between a fan room in which devices such as the outdoor fan 15 are placed and a machine room in which devices such as the compressor 8 are placed.

(2-2) Schematic Structure of Outdoor Heat Exchanger

Figure 4:
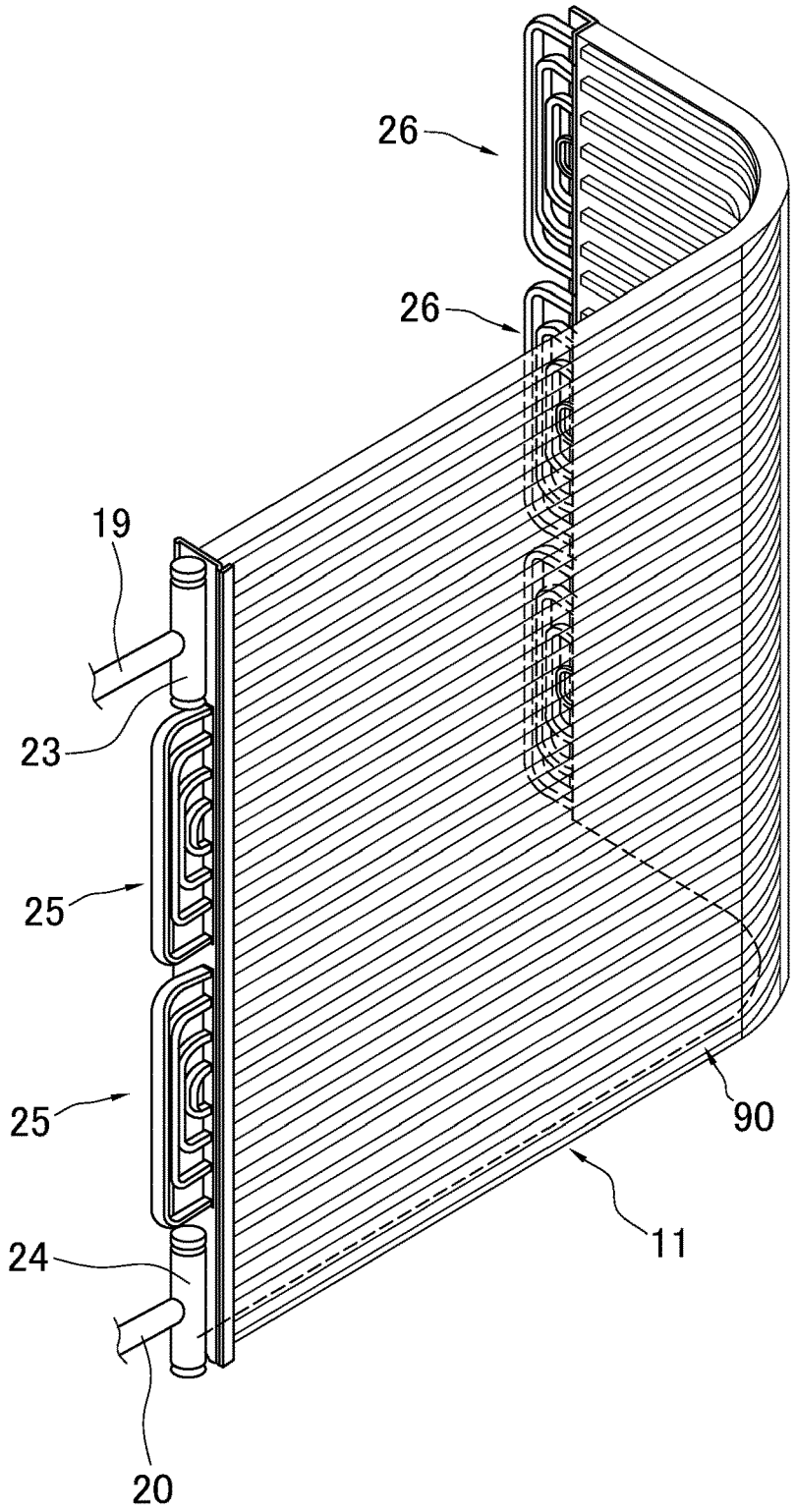
FIG. 4 is a schematic external perspective view of an outdoor heat exchanger.

FIG. 4 is a schematic external perspective view of the outdoor heat exchanger 11.

The outdoor heat exchanger 11 includes mainly a gas-side flow divider 23, a liquid-side flow divider 24, inflow-side turnback members 25, anti-inflow-side turnback members 26, outdoor flat tubes 90, and outdoor fins 91. These components of the outdoor heat exchanger 11 are all made of aluminum or an aluminum alloy and are bonded to each other, for example, by means of brazing.

The outdoor flat tubes 90 are arranged in a manner so as to be adjacent to each other in up-and-down directions.

The outdoor fins 91 are arranged side by side in the plate thickness direction thereof in a manner so as to be adjacent to each other along the outdoor flat tubes 90 and are fixed to the outdoor flat tubes 90.

The gas-side flow divider 23 is connected to a refrigerant pipe 19 and to the outdoor flat tubes 90 on the upper side. When the outdoor heat exchanger 11 functions as a radiator for refrigerant, refrigerant flowing from the refrigerant pipe 19 into the outdoor heat exchanger 11 is divided into flows of refrigerant in different height positions, and the flows of refrigerant are conducted to the outdoor flat tubes 90 on the upper side.

The liquid-side flow divider 24 is connected to a refrigerant pipe 20 and to the outdoor flat tubes 90 on the lower side. When the outdoor heat exchanger 11 functions as a radiator for refrigerant, flows of refrigerant from the outdoor flat tubes 90 on the lower side are merged to drain out of the outdoor heat exchanger 11 through the refrigerant pipe 20.

The inflow-side turnback members 25 are disposed between the gas-side flow divider 23 and the liquid-side flow divider 24. The inflow-side turnback members 25 form connections between end portions of the outdoor flat tubes 90 located in different height positions.

The anti-inflow-side turnback members 26 are provided to an end portion of the outdoor heat exchanger 11. The end portion is opposite to an end portion to which the gas-side flow divider 23, the liquid-side flow divider 24, and the inflow-side turnback members 25 are provided. The anti-inflow-side turnback members 26 form connections between end portions of the outdoor flat tubes 90 located in different height positions.

The outdoor heat exchanger 11 includes the inflow-side turnback members 25 and the anti-inflow-side turnback members 26 as described above. Owing to this feature, refrigerant flowing through the outdoor heat exchanger 11 can turn back at both ends of the outdoor heat exchanger 11.

(2-3) Outdoor Flat Tubes

Figure 5:
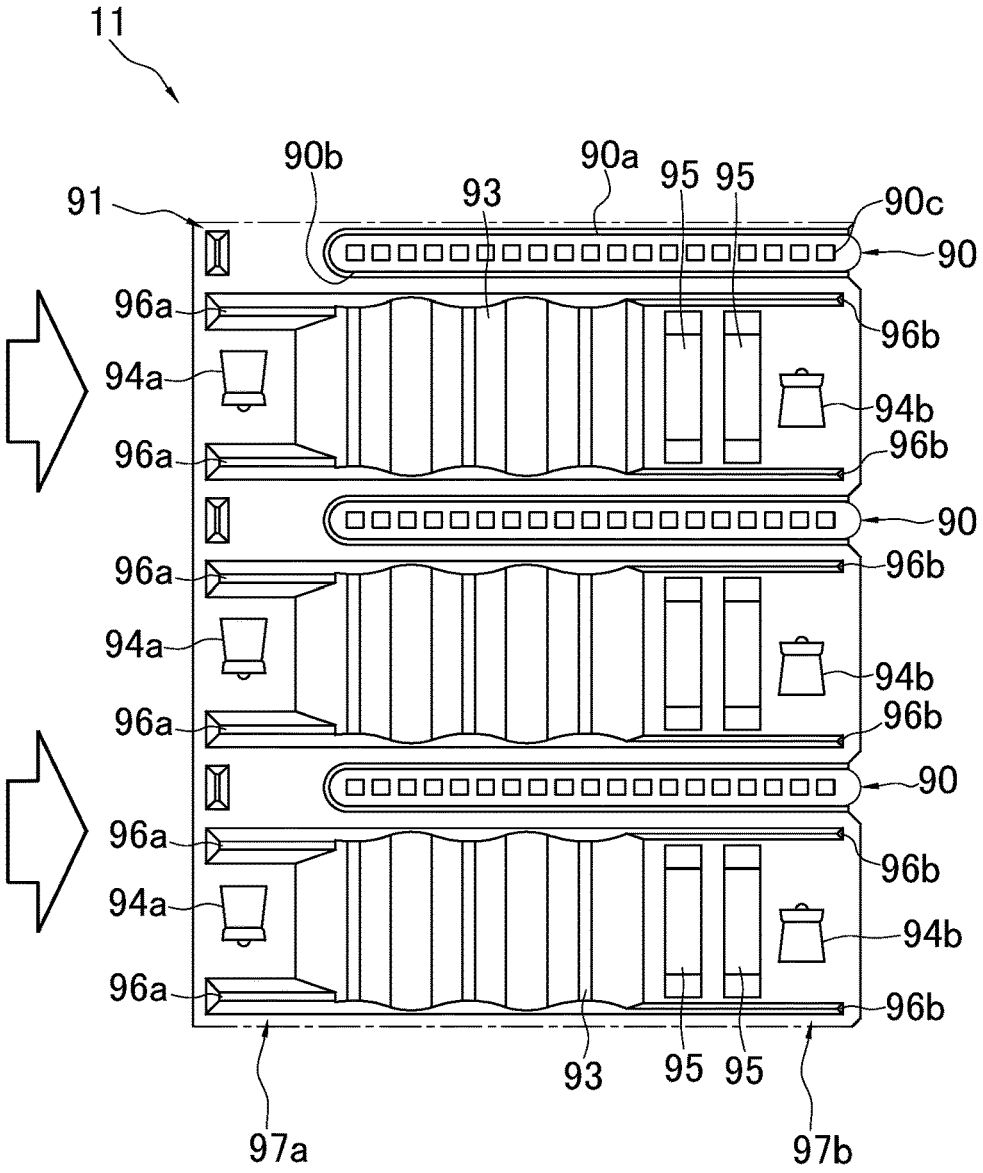
FIG. 5 illustrates the positional relationship between an outdoor fin and outdoor flat tubes.

FIG. 5 illustrates the positional relationship between the outdoor fin 91 and the outdoor flat tubes 90 in a sectional view orthogonal to a direction in which flow paths 90*c* in the outdoor flat tubes 90 extend, with the outdoor fin 91 and the outdoor flat tubes 90 being viewed in the direction in which the flow paths 90*c* extend.

Each outdoor flat tube 90 has: an upper flat surface 90*a*, which faces vertically upward as an upper face; a lower flat surface 90*b*, which faces vertically downward as a lower face; a large number of small flow paths 90*c*, through which refrigerant flows. The flow paths 90*c* of the outdoor flat tube 90 are arranged in a manner so as to be adjacent to each other in the direction of air flow (denoted by arrows in FIG. 5 and corresponding to the longitudinal direction of the outdoor flat tube 90 in the sectional view of the flow paths 90*c*).

(2-4) Outdoor Fins

Each outdoor fin 91 is a plate-shaped member extending in the direction of air flow and in up-and-down directions. The outdoor fins 91 are arranged side by side at predetermined spacings in the plate thickness direction thereof and are fixed to the outdoor flat tubes 90.

Each outdoor fin 91 includes, for example, an outdoor communicating portion 97*a*, leeward portions 97*b*, waffle portions 93, windward-side fin tabs 94*a*, leeward-side fin tabs 94*b*, outdoor slits 95, windward-side ribs 96*a*, and downstream-side ribs 96*b*.

The outdoor communicating portion 97*a* is part of the outdoor fin 91 and extends continuously in up-and-down directions on the windward side of windward-side end portions of the outdoor flat tubes 90.

The leeward portions 97*b* respectively extend from different height positions in the outdoor communicating portion 97*a* toward the downstream side in the direction of air flow. Each leeward portion 97*b* is sandwiched between two outdoor flat tubes 90 being adjacent to each other in up-and-down directions and respectively lying above and below the leeward portion 97*b*.

The waffle portions 93 are in or close to the middle part of the outdoor fin 91 in the direction of air flow, and each waffle portion 93 includes protrusive portions protruding in the plate thickness direction and non-protrusive portions.

The windward-side fin tabs 94*a* are close to windward-side end portions in a manner so as to provide spacing between the individual outdoor fins 91, and the leeward-side fin tabs 94*b* are close to leeward-side end portions in a manner so as to provide spacing between the individual outdoor fins 91.

The outdoor slits 95 are portions cut out and raised in the plate thickness direction from a flat portion and are provided to increase the heat transfer capability of the outdoor fin 91. The outdoor slits 95 are formed on the downstream side of the waffle portion 93 in the direction of air flow. The outdoor slits 95 are formed in such a manner that the longitudinal direction thereof coincides with the up-and-down directions (the direction in which the individual outdoor flat tubes 90 are adjacent to each other). A plurality of outdoor slits 95 (in one or more embodiments shown in the figure, two outdoor slits 95) are arranged side by side in the direction of air flow.

The windward-side ribs 96*a* are formed in such a manner that the individual windward-side ribs 96*a* respectively lying above and below the windward-side fin tab 94*a* extend in the direction of air flow and between the outdoor flat tubes 90 that are adjacent to each other in the up-and-down directions. The leeward-side ribs 96*b* continuously extend from the leeward-side end portions of the corresponding windward-side ribs 96*a* further toward the leeward side.

(3) Indoor Unit (3-1) Schematic Configuration of Indoor Unit

Figure 6:
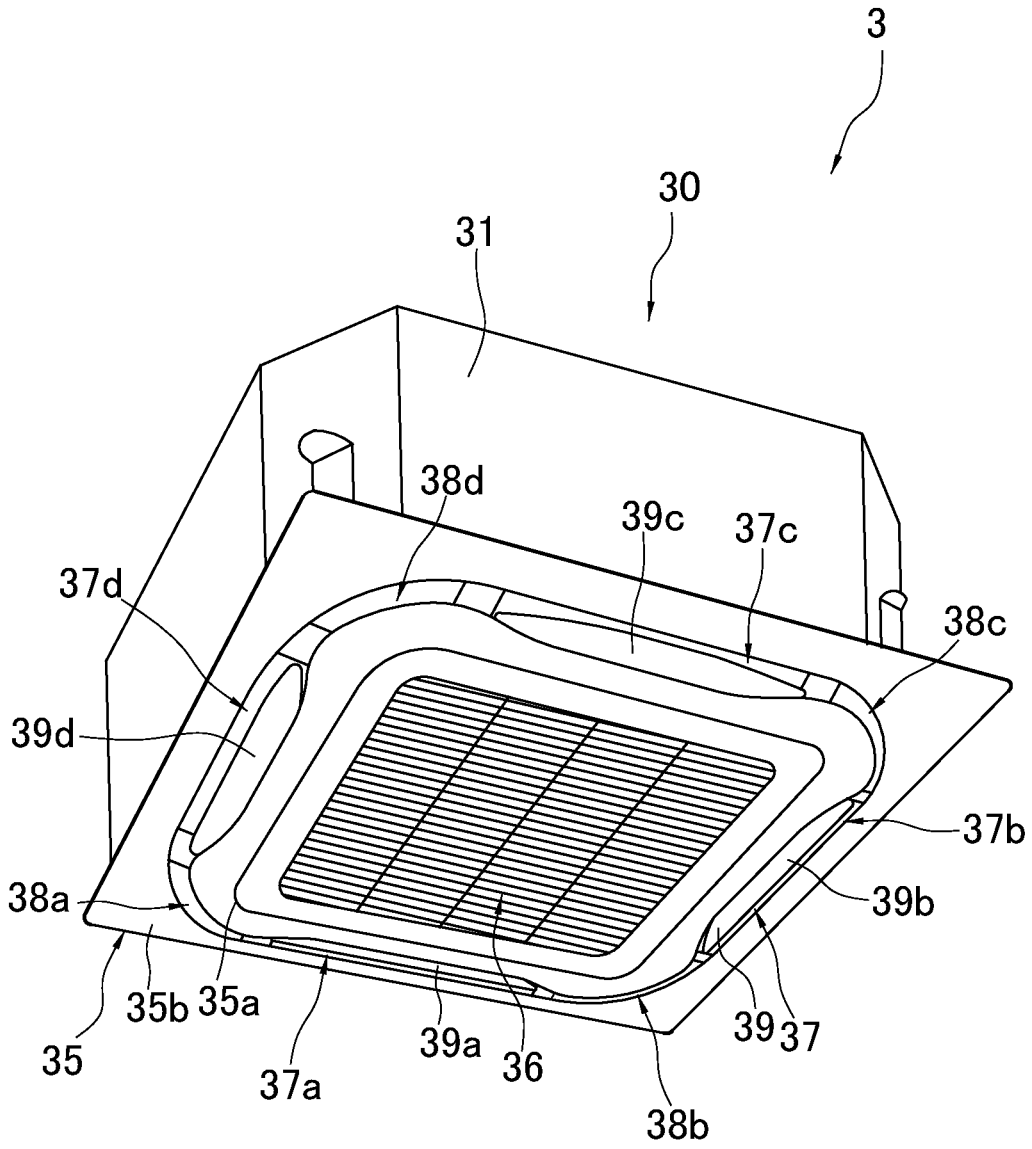
FIG. 6 is a schematic external perspective view of an indoor unit.
Figure 7:
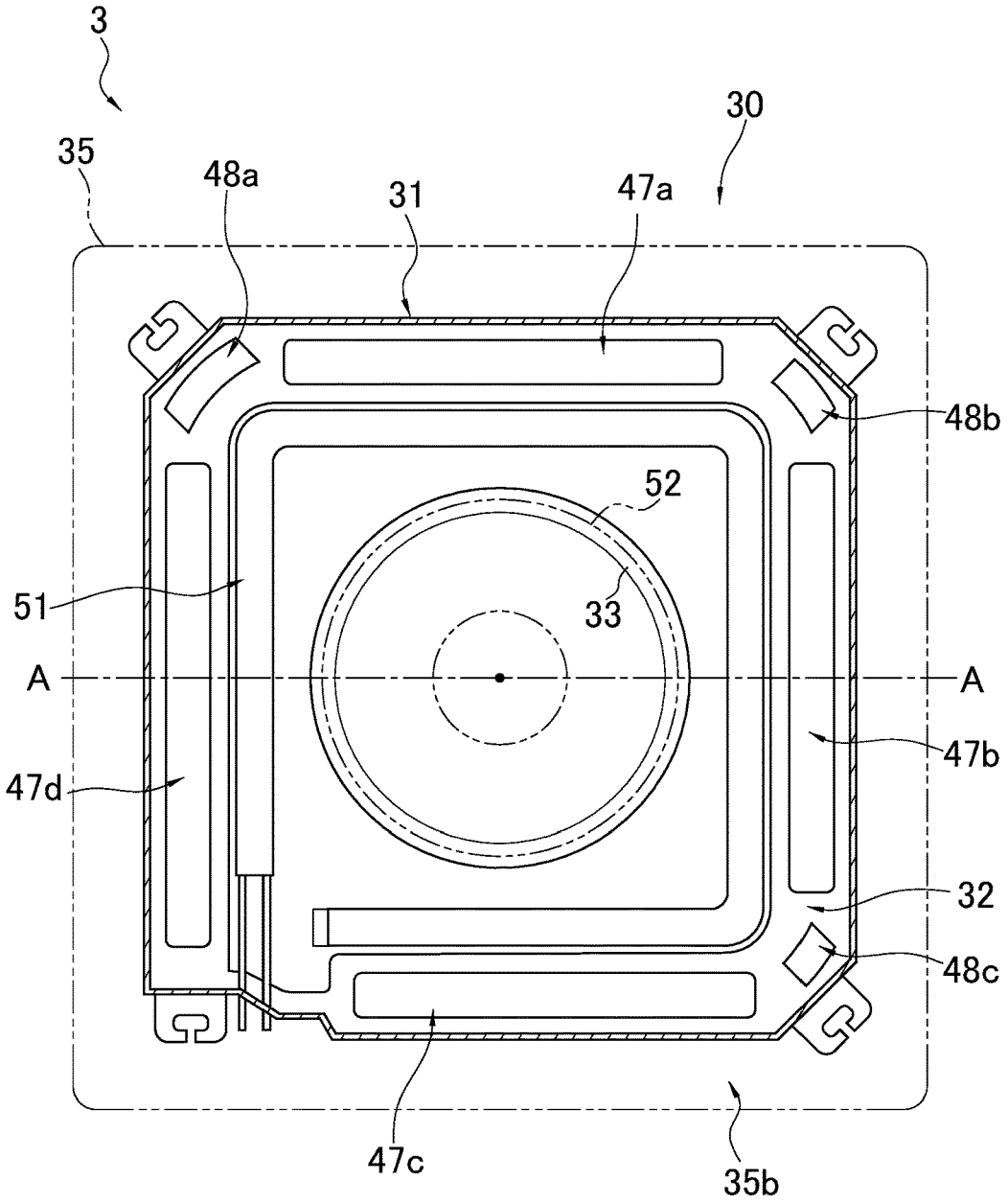
FIG. 7 is a schematic configuration diagram of the indoor unit viewed in plan.
Figure 8:
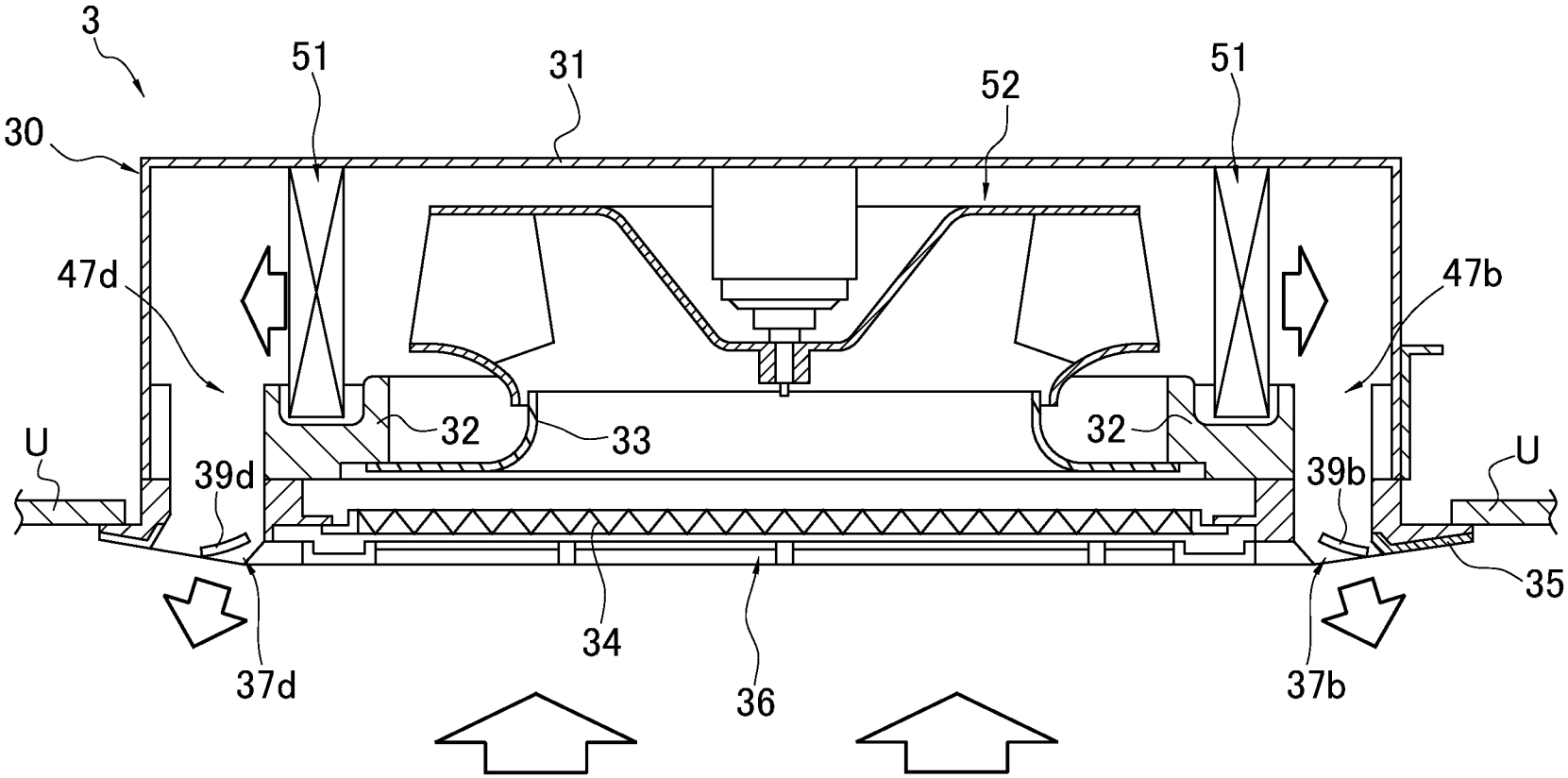
FIG. 8 is a schematic configuration diagram of the indoor unit viewed laterally in a section taken along line A-A in FIG. 7.

FIG. 6 is an external perspective view of the indoor unit 3. FIG. 7 is a schematic plan view of the indoor unit 3, a top panel of which is removed. FIG. 8 is a schematic sectional side view of the indoor unit 3 taken along line A-A in FIG. 7.

The indoor unit 3 in one or more embodiments is an indoor unit of the type that is to be installed in such a way as to be fitted into a cavity of a ceiling of, for example, a room that is a space to be air conditioned. The indoor unit 3 is part of the refrigerant circuit 6. The indoor unit 3 includes mainly the indoor heat exchanger 51, an indoor fan 52, a casing 30, a flap 39, a bell mouth 33, and a drain pan 32.

The indoor heat exchanger 51 is a heat exchanger that functions as an evaporator for refrigerant transmitted from the outdoor heat exchanger 11 during the cooling operation and functions as a radiator for refrigerant discharged by the compressor 8 during the heating operation. The liquid side of the indoor heat exchanger 51 is connected to the indoor-side end portion of the liquid-refrigerant connection pipe 4, and the gas side of the indoor heat exchanger 51 is connected to the indoor-side end portion of the gas-refrigerant connection pipe 5.

The indoor fan 52 is a centrifugal blower disposed inside a casing body 31 of the indoor unit 3. The indoor fan 52 creates air flow (denoted by arrows in FIG. 8) by sucking room air into the casing 30 through a suction opening 36 of a decorative panel 35, letting the air through the indoor heat exchanger 51, and then blowing the air out of the casing 30 through a blow-out opening 37 of the decorative panel 35. The room air supplied by the indoor fan 52 in this manner exchanges heat with refrigerant in the indoor heat exchanger 51, and the temperature of the room air is adjusted accordingly.

The casing 30 includes mainly the casing body 31 and the decorative panel 35.

The casing body 31 is installed in such a way as to be inserted into an opening formed in a ceiling U of a room to be air conditioned. The casing body 31 is a box-like body and has a substantially octagonal shape defined by alternating long and short sides when viewed in plan. The casing body 31 is open on the underside thereof. The casing body 31 has a top panel and side panels extending downward from a peripheral edge portion of the top panel.

The decorative panel 35 is installed in such a way as to be fitted into the opening of the ceiling U and lies off the top panel and the side panels of the casing body 31 when viewed in plan. The decorative panel 35 is fitted to a lower part of the casing body 31 from the indoor side. The decorative panel 35 includes an inner frame 35*a* and an outer frame 35*b*. The suction opening 36 is provided in on the inner side with respect to the inner frame 35*a*. The suction opening 36 is an opening facing downward and is substantially quadrilateral. A filter 34, which is for removing dust in the air sucked in through the suction opening 36, is disposed above the suction opening 36. The blow-out opening 37 and a corner blow-out opening 38, which are openings facing obliquely downward from the lower side, are provided on the inner side with respect to the outer frame 35*b* and on the outer side with respect to the inner frame 35*a*. The blow-out opening 37 includes a first blow-out opening 37*a*, a second blow-out opening 37*b*, a third blow-out opening 37*c*, and a fourth blow-out opening 37*d*, whose positions correspond to sides of the substantially quadrilateral shape of the decorative panel 35 viewed in plan. The corner blow-out opening 38 includes a first corner blow-out opening 38*a*, a second corner blow-out opening 38*b*, a third corner blow-out opening 38*c*, and a fourth corner blow-out opening 38*d*, whose positions correspond to four corners of the substantially quadrilateral shape of the decorative panel 35 viewed in plan.

The flap 39 is a member capable of changing the direction of air flow passing through the blow-out opening 37. The flap 39 includes a first flap 39*a* in the first blow-out opening 37*a*, a second flap 39*b* in the second blow-out opening 37*b*, a third flap 39*c* in the third blow-out opening 37*c*, and a fourth flap 39*d* in the fourth blow-out opening 37*d*. The flaps 39*a* to 39*d* are rotatably supported about their respective axes at predetermined positions in the casing 30.

The drain pan 32 is disposed below the indoor heat exchanger 51 to receive drain water generated in the indoor heat exchanger 51 by condensation of moisture in the air. The drain pan 32 is fitted in a lower portion of the casing body 31. When viewed in plan, the drain pan 32 defines a cylindrical space provided on the inner side with respect to the indoor heat exchanger 51 and extending in up-and-down directions. The bell mouth 33 is disposed in an inner, lower part of the space. The bell mouth 33 guides, to the indoor fan 52, air sucked in through the suction opening 36. When viewed in plan, the drain pan 32 defines blow-out flow paths 47*a* to 47*d* and corner blow-out flow paths 48*a* to 48*c*, which are provided on the outer side with respect to the indoor heat exchanger 51 and extend in up-and-down directions. The blow-out flow paths 47*a* to 47*d* include: a first blow-out flow path 47*a* communicating with the first blow-out opening 37*a* at a lower end thereof; a second blow-out flow path 47*b* communicating with the second blow-out opening 37*b* at a lower end thereof; a third blow-out flow path 47*c* communicating with the third blow-out opening 37*c* at a lower end thereof; and a fourth blow-out flow path 47*d* communicating with the fourth blow-out opening 37*d* at a lower end thereof. The corner blow-out flow paths 48*a* to 48*c* include: a first corner blow-out flow path 48*a* communicating with the first corner blow-out opening 38*a* at a lower end thereof; a second corner blow-out flow path 48*b* communicating with the second corner blow-out opening 38*b* at a lower end thereof; and a third corner blow-out flow path 48*c* communicating with the third corner blow-out opening 38*c* at a lower end thereof.

(3-2) Schematic Structure of Indoor Heat Exchanger

Figure 9:
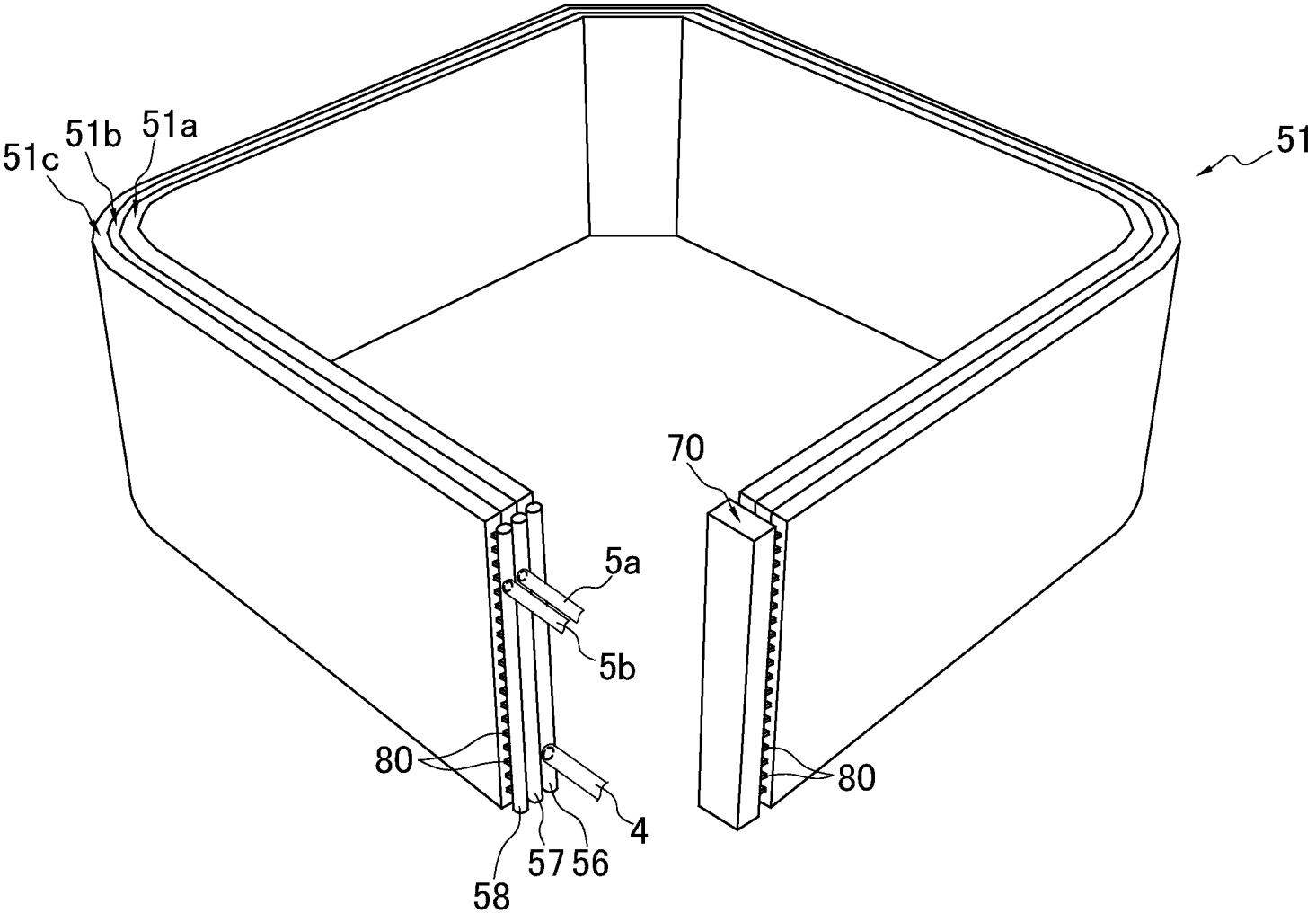
FIG. 9 is a schematic external perspective view of an indoor heat exchanger.
Figure 10:
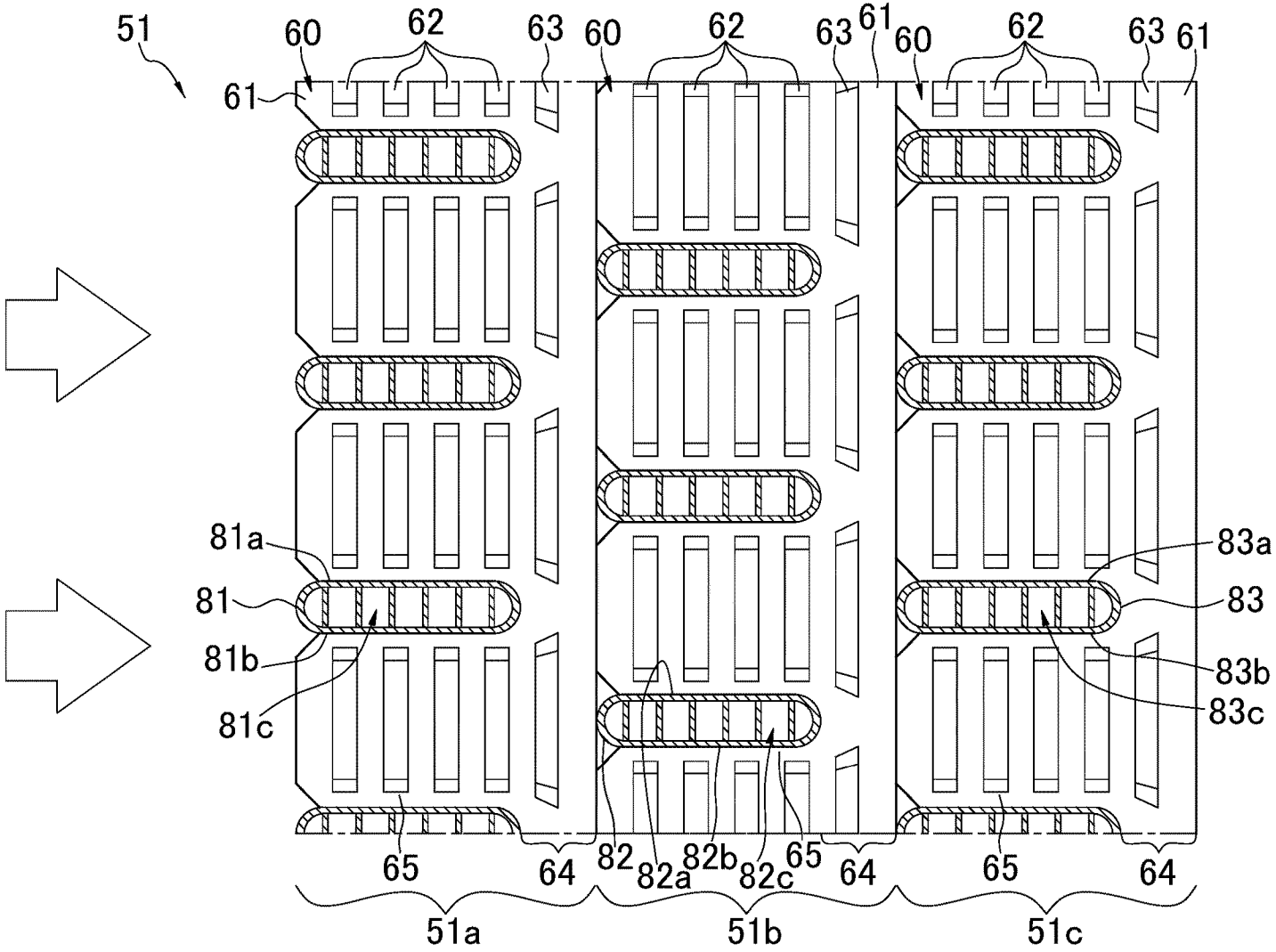
FIG. 10 illustrates the positional relationship between indoor fins, indoor windward flat tubes, first indoor leeward flat tubes, and second indoor leeward flat tubes.
Figure 11:
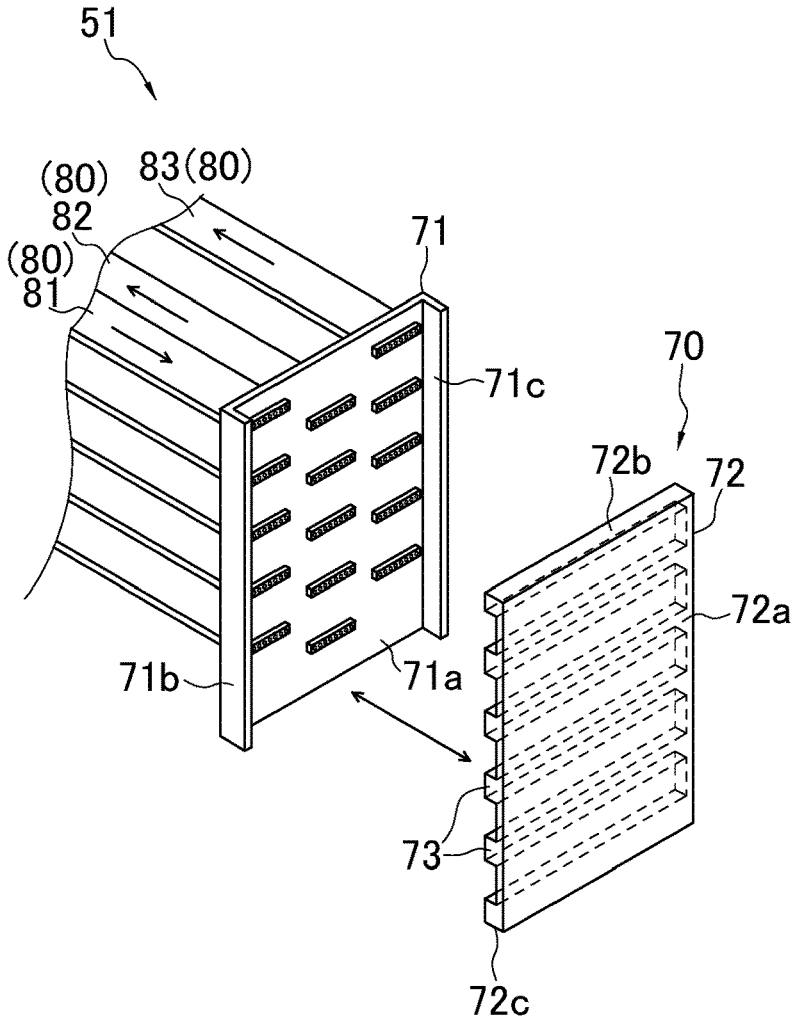
FIG. 11 is an exploded schematic perspective view of part of a distribution header and components adjacent thereto (except for the indoor fins).
Figure 12:
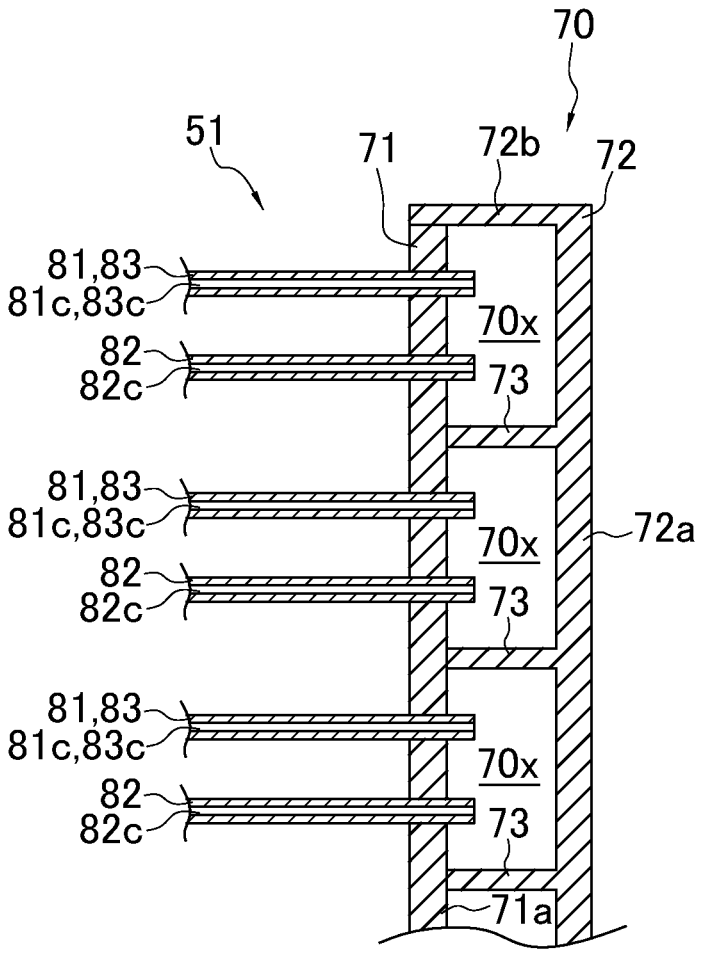
FIG. 12 is a configuration diagram of the distribution header and components adjacent thereto (except for the indoor fins), schematically illustrating the layout of the distribution header and the components viewed in the direction of air flow.
Figure 13:
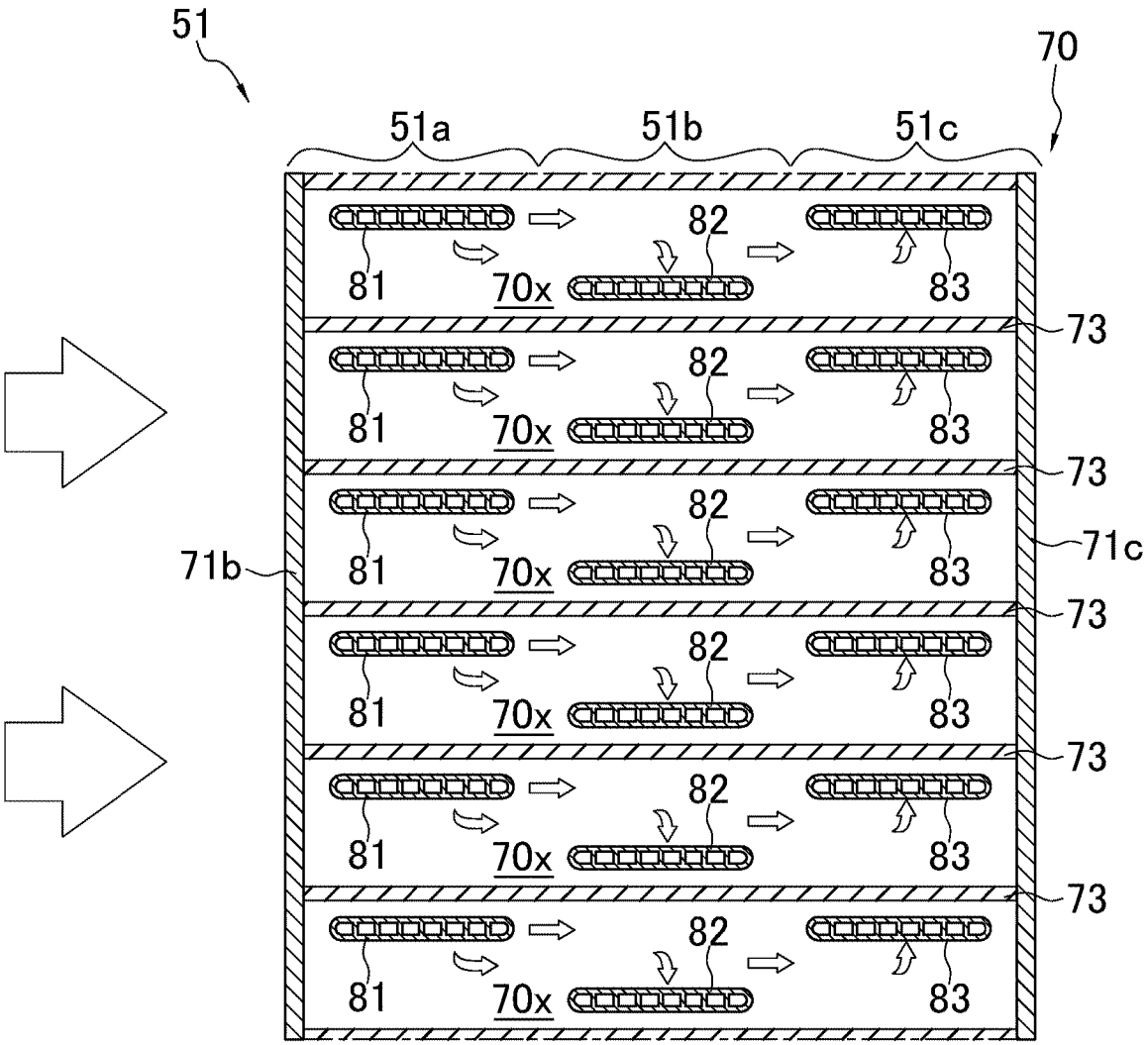
FIG. 13 is a configuration diagram of the distribution header and components adjacent thereto, schematically illustrating the layout of the distribution header and the components viewed in a direction in which flow paths in the indoor windward flat tubes, flow paths in the first indoor leeward flat tubes, and flow paths in the second leeward flat tubes extend.

FIG. 9 is a schematic external perspective view of the indoor heat exchanger 51. FIG. 10 illustrates the positional relationship between the indoor fins 60, indoor windward flat tubes 81, first indoor leeward flat tubes 82, and second indoor leeward flat tubes 83 in a sectional view orthogonal to a direction in which flow paths 81*c* in the indoor windward flat tubes 81, flow paths 82*c* in the first indoor leeward flat tubes 82, and flow paths 83*c* in the second indoor leeward flat tubes 83 extend, with the indoor fins 60, the indoor windward flat tubes 81, the first indoor leeward flat tubes 82, and the second indoor leeward flat tubes 83 being viewed in the direction in which the flow paths 81*c*, 82*c*, and 83*c* extend. FIG. 11 is an exploded schematic perspective view of part of a distribution header 70 and components adjacent thereto (except for the indoor fins 60). FIG. 12 is a configuration diagram of the distribution header 70 and components adjacent thereto (except for the indoor fins 60), schematically illustrating the layout of the distribution header 70 and the components viewed in the direction of air flow. FIG. 13 is a configuration diagram of the distribution header 70 and components adjacent thereto, schematically illustrating the layout of the distribution header 70 and the components viewed in the direction in which the flow paths 81*c* in the indoor windward flat tubes 81, the flow paths 82*c* in the first indoor leeward flat tubes 82, and the flow paths 83*c* in the second indoor leeward flat tubes 83 extend.

The indoor heat exchanger 51 is disposed inside the casing body 31 and in the same height position as the indoor fan 52 in a manner so as to surround the indoor fan 52. The indoor heat exchanger 51 includes mainly a liquid-side header 56, a first gas-side header 57, a second gas-side header 58, indoor flat tubes 80, the indoor fins 60, and the distribution header 70. These components of the indoor heat exchanger 51 are all made of aluminum or an aluminum alloy and are bonded to each other, for example, by means of brazing.

The indoor heat exchanger 51 includes: a windward heat exchange section 51*a* (an inner portion in a plan view) on the windward side in the direction of air flow; a second leeward heat exchange section 51*c* (an outer portion in the plan view) on the leeward side in the direction of air flow; and a first leeward heat exchange section 51*b* between the windward heat exchange section 51*a* and the leeward heat exchange section 51*c* in the direction of air flow.

The liquid-side header 56 is an end of the windward heat exchange section 51*a* of the indoor heat exchanger 51 viewed in plan and is a cylindrical member extending in up-and-down directions. The liquid-side header 56 is connected with the indoor-side end portion of the liquid-refrigerant connection pipe 4. The liquid-side header 56 is also connected with the indoor windward flat tubes 81, which are the indoor flat tubes 80 constituting the windward heat exchange section 51*a* of the indoor heat exchanger 51 and are arranged in a manner so as to be adjacent to each other in up-and-down directions.

The first gas-side header 57 is an end of the first leeward heat exchange section 51*b* of the indoor heat exchanger 51 viewed in plan and is a cylindrical member extending in up-and-down directions. The first gas-side header 57 is connected with a first gas-refrigerant connection pipe 5*a*, which is a branch pipe extending from the indoor-side end portion of the gas-refrigerant connection pipe 5. The first gas-side header 57 is also connected with the first indoor leeward flat tubes 82, which are the indoor flat tubes 80 constituting the first leeward heat exchange section 51*b* of the indoor heat exchanger 51 and are arranged in a manner so as to be adjacent to each other in up-and-down directions.

The second gas-side header 58 is an end of the second leeward heat exchange section 51*c* of the indoor heat exchanger 51 viewed in plan and is a cylindrical member extending in up-and-down directions. The second gas-side header 58 is connected with a second gas-refrigerant connection pipe 5*b*, which is a branch pipe extending from the indoor-side end portion of the gas-refrigerant connection pipe 5. The second gas-side header 58 is also connected with the second indoor leeward flat tubes 83, which are the indoor flat tubes 80 constituting the second leeward heat exchange section 51*c* of the indoor heat exchanger 51 and are arranged in a manner so as to be adjacent to each other in up-and-down directions.

(3-3) Indoor Flat Tubes

The indoor flat tubes 80 include: the indoor windward flat tubes 81 constituting the windward heat exchange section 51*a*; the first indoor leeward flat tubes 82 constituting the first leeward heat exchange section 51*b*; and the second indoor leeward flat tubes 83 constituting the second leeward heat exchange section 51*c*. More specifically, the indoor flat tubes 80 include: the indoor windward flat tubes 81 arranged in a manner so as to be adjacent to each other in up-and-down directions in the windward heat exchange section 51*a* of the indoor heat exchanger 51; the first indoor leeward flat tubes 82 arranged in a manner so as to be adjacent to each other in up-and-down directions in the first leeward heat exchange section 51*b* of the indoor heat exchanger 51; and the second indoor leeward flat tubes 83 arranged in a manner so as to be adjacent to each other in up-and-down directions in the second leeward heat exchange section 51*c* of the indoor heat exchanger 51. The indoor heat exchanger 51 in which three or more heat exchange sections (indoor flat tubes 80) are arranged side by side in the direction of air flow may offer sufficiently higher performance. One end of each of the indoor windward flat tubes 81 constituting the windward heat exchange section 51*a* is connected to the liquid-side header 56, and the other end thereof is connected to a windward-side portion of the distribution header 70. One end of each of the second indoor leeward flat tubes 83 constituting the second leeward heat exchange section 51*c* is connected to the second gas-side header 58, and the other end thereof is connected to a leeward-side portion of the distribution header 70. One end of each of the first indoor leeward flat tubes 82 constituting the first leeward heat exchange section 51*b* is connected to the first gas-side header 57, and the other end thereof is connected to a portion being part of the distribution header 70 and located between the portion connected with the indoor windward flat tubes 81 and the portion connected with the second indoor leeward flat tubes 83.

The pitch of the indoor windward flat tubes 81 in the height direction, the pitch of the first indoor leeward flat tubes 82 in the height direction, and the pitch of the second indoor leeward flat tubes 83 in the height direction are equal to one another in the indoor heat exchanger 51 according to one or more embodiments. The flat tubes in the indoor heat exchanger 51 according to one or more embodiments are arranged as follows. The indoor windward flat tubes 81 and the second indoor leeward flat tubes 83 overlap each other when viewed in the direction of air flow. The indoor windward flat tubes 81 and the second indoor leeward flat tubes 83 do not overlap the first indoor leeward flat tubes 82 when viewed in the direction of air flow.

The indoor windward flat tubes 81, the first indoor leeward flat tubes 82, and the second indoor leeward flat tubes 83 have the same shape and the same dimensions. This enables cost reduction. Each indoor windward flat tube 81, each first indoor leeward flat tube 82, and each second indoor leeward flat tube 83 respectively have: upper flat surfaces 81*a*, 82*a*, and 83*a*, each of which faces vertically upward as an upper face; lower flat surfaces 81*b*, 82*b*, and 83*b*, each of which faces vertically downward as a lower face; a large number of small flow paths 81*c*, 82*c*, and 83*c*, through which refrigerant flows. The flow paths 81*c* of the indoor windward flat tubes 81, the flow paths 82*c* of the first indoor leeward flat tubes 82, and the flow paths 83*c* of the second indoor leeward flat tubes 83 are arranged in a manner so as to be adjacent to each other in the direction of air flow (denoted by arrows in FIG. 10 and corresponding to the longitudinal direction of the indoor windward flat tubes 81, the first indoor leeward flat tubes 82, and the second indoor leeward flat tubes 83 in the sectional view of the flow paths 81*c*, 82*c*, and 83*c*).

(3-4) Indoor Fins

Similarly, the indoor fins 60 include indoor fins constituting the windward heat exchange section 51*a*, indoor fins constituting the first leeward heat exchange section 51*b*, and indoor fins constituting the second leeward heat exchange section 51*c*. More Specifically, the indoor fins 60 include: indoor fins fixed to the indoor windward flat tubes 81 constituting the windward heat exchange section 51*a*; indoor fins fixed to the first indoor leeward flat tubes 82 constituting the first leeward heat exchange section 51*b*; and indoor fins fixed to the second indoor leeward flat tubes 83 constituting the second leeward heat exchange section 51*c*. The indoor fins 60 are arranged side by side in the plate thickness direction of the indoor fins 60 along the indoor windward flat tubes 81, the first indoor leeward flat tubes 82, and the second indoor leeward flat tubes 83.

The indoor fins 60 constituting the windward heat exchange section 51*a*, the indoor fins 60 constituting the first leeward heat exchange section 51*b*, and the indoor fins 60 constituting the second leeward heat exchange section 51*c* have the same shape and the same dimensions. This enables cost reduction. The indoor fins 60 are plate-shaped members extending in the direction of air flow and in up-and-down directions and are arranged at predetermined spacings in the plate thickness direction thereof. Each indoor fin 60 is fixed to the indoor windward flat tubes 81, the first indoor leeward flat tubes 82, or the second indoor leeward flat tubes 83.

Each indoor fin 60 includes, for example, a main surface 61, an indoor communicating portion 64, windward portions 65, main slits 62, and communication position slits 63. The main surface 61 is part of the indoor fin 60 and is a flat portion in which the main slits 62 and the communication position slits 63 are not provided. The indoor communicating portion 64 is part of the indoor fin 60 and continuously extends in up-and-down directions on the leeward side of leeward-side end portions of the indoor flat tube 80. The main slits 62 are portions cut out and raised in the plate thickness direction from the flat main surface 61 and are provided to increase the heat transfer capability of the indoor fin 60. The individual main slits 62 are formed in the corresponding windward portions 65 of the indoor fin 60. The main slits 62 are arranged in rows, each of which includes a plurality of main slits (in one or more embodiments shown in the figure, four main slits) arranged side by side in the direction of air flow. Similarly, the communication position slits 63 are portions cut and raised in the plate thickness direction from the flat main surface 61 in the indoor communicating portion 64 and are provided to increase the heat transfer capability of the indoor fin 60. The communication position slits 63 are provided on the downstream side of the corresponding main slits 62 in the direction of air flow in the respective height positions. Each communication position slit 63 is provided in such a manner that the longitudinal direction thereof coincides with the up-and-down directions. The communication position slit 63 extends in the up-and-down directions, with the upper end of the communication position slit 63 being above the upper ends of the corresponding main slits 62 and the lower end of the communication position slit 63 being below the lower ends of the corresponding main slits 62. The main slits 62 and the communication position slits 63 are cut and raised from the flat main surface 61 in a manner so as to be on the same side in the plate thickness direction and thus define openings on the upstream side and the downstream side in the direction of air flow.

(3-5) Distribution Header

The distribution header 70 is an end portion of the indoor heat exchanger 51 viewed in plan. The end portion is opposite to an end portion to which the liquid-side header 56, the first gas-side header 57, and the second gas-side header 58 are provided. The distribution header 70 is a member extending in up-and-down directions. The distribution header 70 is configured to enable flows of refrigerant coming out of the respective indoor flat tubes 80 to turn back in such a manner that each flow of refrigerant is distributed to different indoor flat tubes 80.

The distribution header 70 includes a tube plate member 71 and a distribution member 72.

The tube plate member 71 includes a tube plate 71*a*, an inner side wall 71*b*, and an outer side wall 71*c*. The tube plate 71*a* has openings extending therethrough in the plate thickness direction. The indoor flat tubes 80 are fitted in the respective openings. The tube plate 71*a* has a rectangular face extending in directions orthogonal to the longitudinal direction of the indoor flat tubes 80 piercing through the tube plate 71*a* and is a wall surface of the distribution header 70 closer than another wall surface to the indoor flat tubes 80. The inner side wall 71*b* of the tube plate member 71 extends from an inner end portion of the tube plate 71*a* in the longitudinal direction of the indoor flat tubes 80 and is an inner side face of the distribution header 70. The outer side wall 71*c* of the tube plate member 71 extends from an outer end portion of the tube plate 71*a* in the longitudinal direction of the indoor flat tubes 80 and is an outer side face of the distribution header 70.

The distribution member 72 includes a turnback wall 72*a*, an upper end wall 72*b*, a lower end wall 72*c*, and partition plates 73. The distribution member 72 is fixed to the tube plate member 71, and distribution spaces 70*x* are defined in the distribution member 72 accordingly. The turnback wall 72*a* has a rectangular face extending parallel to a surface of the tube plate 71*a* in a manner so as to face the surface of the tube plate 71*a* and is a wall surface of the distribution header 70 opposite to the wall surface closer to the indoor flat tubes 80. The indoor flat tubes 80 piercing through the tube plate 71*a* are not in contact with the turnback wall 72*a*. The upper end wall 72*b* extends from an upper end of the turnback wall 72*a* to an upper edge portion of the tube plate 71*a* of the tube plate member 71 and is an upper face of the distribution header 70. The lower end wall 72*c* extends from a lower end of the turnback wall 72*a* to a lower edge portion of the tube plate 71*a* of the tube plate member 71 and is a lower face of the distribution header 70. The partition plates 73 respectively extend from different height positions of the turnback wall 72*a* toward the indoor flat tubes 80. The partition plates 73 are disposed between the upper end wall 72*b* and the lower end wall 72*c* in a manner so as to be adjacent to each other in up-and-down directions. Specifically, each partition plate 73 is a partition between the distribution spaces 70*x* in the distribution header 70 that are adjacent to each other in the up-and-down directions. In other words, the partition plates 73 extending from the turnback wall 72*a* lie horizontally in a manner so as to be in contact with the tube plate 71*a*, the inner side wall 71*b*, and the outer side wall 71*c*. In one or more embodiments, upper and lower faces defining the distribution spaces 70*x* in different height positions are flat surfaces extending in the direction of air flow in the respective height positions.

The distribution spaces 70*x* adjacent to each other in the height direction are connected with the indoor windward flat tubes 81 constituting the windward heat exchange section 51*a*, the first indoor leeward flat tubes 82 constituting the first leeward heat exchange section 51*b*, and the second indoor leeward flat tubes 83 constituting the second leeward heat exchange section 51*c* in such a manner that the individual distribution spaces are connected with flat tubes in the corresponding height positions. The distribution header 70 thus eliminates or reduces the possibility that flows of refrigerant coming out of the indoor windward flat tubes 81 in different height positions will mix with each other. Furthermore, the distribution header 70 enables flows of refrigerant coming out of the indoor windward flat tubes 81 in the respective height positions to turn back in such a manner that each flow of refrigerant is distributed to the corresponding one of the indoor leeward flat tubes 82 and the corresponding one of the second indoor leeward flat tubes 83. Specifically, when functioning as an evaporator for refrigerant, the indoor heat exchanger 51 causes refrigerant to flow in the following manner: flows of refrigerant coming out of the indoor windward flat tubes 81 in the respective height positions turn back in the distribution header 70 and are distributed to the first indoor leeward flat tubes 82 and the second indoor leeward flat tubes 83 in the corresponding height positions. When functioning as a condenser for refrigerant, the indoor heat exchanger 51 causes refrigerant to flow in the following manner. Flows of refrigerant coming out of the first indoor leeward flat tubes 82 in the respective height positions merge with flows of refrigerant coming out of the second indoor leeward flat tubes 83 in the corresponding height positions while these flows of refrigerant turn back in the indoor heat exchanger 51. Then, resultant flows enter the indoor windward flat tubes 81 in corresponding height positions.

In one or more embodiments, each of the distribution spaces 70*x* in the respective height positions is connected with the corresponding one of the indoor windward flat tubes 81, the corresponding one of the second indoor leeward flat tubes 83, and the corresponding one of the first indoor leeward flat tubes 82. The indoor windward flat tube 81 and the second indoor leeward flat tube 83 are in the same height position. The first indoor leeward flat tube 82 is in a height position lower than the height position concerned (in a height position lower than the height position of the indoor windward flat tube 81 and the second indoor leeward flat tube 83 and higher than the height position of another indoor windward flat tube 81 and another second indoor leeward flat tube 83 immediately below the relevant indoor windward flat tube 81 and the relevant second indoor leeward flat tube 83). Consequently, refrigerant flows in the following manner. When, for example, the indoor heat exchanger 51 functions as an evaporator for refrigerant, flows of refrigerant coming out of the indoor windward flat tubes 81 enter the respective distribution spaces 70*x*, in which each flow of refrigerant is distributed to the first indoor leeward flat tube 82 in a position lower than the position of the indoor windward flat tube 81 concerned and the second indoor leeward flat tube 83 in the same position as the indoor windward flat tube 81 concerned.

(4) Actions of Air Conditioner

The following describes actions of the air conditioner 1 with reference to FIG. 1. The air conditioner 1 performs: the cooling operation during which refrigerant flows through the compressor 8, the outdoor heat exchanger 11, the outdoor expansion valve 12, and the indoor heat exchanger 51 in the stated order; and the heating operation during which refrigerant flows through the compressor 8, the indoor heat exchanger 51, the outdoor expansion valve 12, and the outdoor heat exchanger 11 in the stated order.

(4-1) Cooling Operation

For the cooling operation, the four-way switching valve 10 is switched to the connected state (see solid lines in FIG. 1) in which the outdoor heat exchanger 11 serves as a radiator for refrigerant and the indoor heat exchanger 51 serves as an evaporator for refrigerant. The refrigerant circuit 6 is configured as follows. Gas refrigerant at a low pressure in the refrigeration cycle is sucked into the compressor 8, compressed to a high pressure in the refrigeration cycle, and is then discharged. The high-pressure gas refrigerant discharged by the compressor 8 is transmitted to the outdoor heat exchanger 11 through the four-way switching valve 10. After flowing into the outdoor heat exchanger 11 functioning as a radiator for refrigerant, the high-pressure gas refrigerant transfers heat in the outdoor heat exchanger 11 by exchanging heat with outdoor air supplied as a cooling source by the outdoor fan 15 and is thus transformed into high-pressure liquid refrigerant. When the high-pressure liquid refrigerant flows through the outdoor expansion valve 12, the pressure of the high-pressure liquid refrigerant is reduced to a low pressure in the refrigeration cycle. The resultant refrigerant in the gas-liquid two-phase state is transmitted to the indoor unit 3 through the liquid-side shutoff valve 13 and the liquid-refrigerant connection pipe 4.

In the indoor heat exchanger 51, the low-pressure refrigerant in the gas-liquid two-phase state evaporates by exchanging heat with indoor air supplied as a heat source by the indoor fan 52 during the cooling operation. Consequently, the air flowing passing by the indoor heat exchanger 51 is cooled, and the room is cooled accordingly. When the air passes by the indoor heat exchanger 51, moisture in the air is condensed, and consequently, condensation forms on the surface of the indoor heat exchanger 51. After evaporating in the indoor heat exchanger 51, the low-pressure gas refrigerant is transmitted to the outdoor unit 2 through the gas-refrigerant connection pipe 5.

The low-pressure gas refrigerant in the outdoor unit 2 flows through the gas-side shutoff valve 14, the four-way switching valve 10, and the accumulator 7 and is then sucked back into the compressor 8. In this way, refrigerant circulates through the refrigerant circuit 6 during the cooling operation.

(4-2) Heating Operation

For the heating operation, the four-way switching valve 10 is switched to the connected state (see broken lines in FIG. 1) in which the outdoor heat exchanger 11 serves as an evaporator for refrigerant and the indoor heat exchanger 51 serves as a radiator for refrigerant. The refrigerant circuit 6 is configured as follows. Gas refrigerant at a low pressure in the refrigeration cycle is sucked into the compressor 8, compressed to a high pressure in the refrigeration cycle, and is then discharged. The high-pressure gas refrigerant discharged by the compressor 8 is transmitted to the indoor unit 3 through the four-way switching valve 10, the gas-side shutoff valve 14, and the gas-refrigerant connection pipe 5.

In the indoor heat exchanger 51, the high-pressure gas refrigerant transfers heat by exchanging heat with indoor air supplied as a cooling source by the indoor fan 52 and is thus transformed into high-pressure liquid refrigerant. Consequently, the air flowing passing by the indoor heat exchanger 51 is heated, and the room is heated accordingly. After transferring heat in the indoor heat exchanger 51, the high-pressure liquid refrigerant is transmitted to the outdoor unit 2 through the liquid-refrigerant connection pipe 4.

The high-pressure liquid refrigerant in the outdoor unit 2 flows through the liquid-side shutoff valve 13 and enters the outdoor expansion valve 12, where the pressure of the refrigerant is reduced to a low pressure in the refrigeration cycle. The resultant refrigerant is low-pressure refrigerant in the gas-liquid two-phase state. After being decompressed in the outdoor expansion valve 12 and flowing into the outdoor heat exchanger 11 functioning as an evaporator for refrigerant, the low-pressure refrigerant in the gas-liquid two-phase state evaporates by exchanging heat with outdoor air supplied as a heat source by the outdoor fan 15 and is thus transformed into low-pressure gas refrigerant. The low-pressure gas refrigerant flows through the four-way switching valve 10 and the accumulator 7 and is then sucked back into the compressor 8. In this way, refrigerant circulates through the refrigerant circuit 6 during the heating operation.

(5) Features (5-1)

An indoor heat exchanger proposed and known in the art includes, for added performance, heat transfer tubes arranged in columns adjacent to each other in the direction of air flow. Such an indoor heat exchanger may include: cylindrical heat transfer tubes arranged in columns adjacent to each other in the direction of air flow; and connection pipes each of which is circular in cross section and forms a connection between an end portion of a cylindrical heat transfer tube in a column and an end portion of a cylindrical heat transfer tube in another column. Each connection pipe branches off from a branch portion, where a flow of refrigerant is divided and distributed accordingly.

However, no mention is made of a structure for distributing refrigerant in a heat exchanger that includes flat tubes having a flat shape instead of including the cylindrical heat transfer tubes.

As a workaround, the indoor heat exchanger 51 according to one or more embodiments enables refrigerant to flow in the following manner. When, for example, the indoor heat exchanger 51 functions as an evaporator for refrigerant, flows of refrigerant coming out of the indoor windward flat tubes 81 having a flat shape are distributed in the respective distribution spaces 70*x* and enter the corresponding first indoor leeward flat tubes 82 and the corresponding second indoor leeward flat tubes 83 as denoted by arrows in FIG. 13. Thus, the indoor flat tubes 80 having a flat shape may be used in the indoor heat exchanger 51 in a manner so as to distribute flows of refrigerant appropriately.

(5-2)

The distribution spaces 70*x* are provided to an end portion of the indoor heat exchanger 51. Owing to this feature of the indoor heat exchanger 51 according to one or more embodiments, flows of refrigerant coming out of the indoor windward flat tubes 81 can not only branch off to enter the corresponding first indoor leeward flat tubes 82 and the corresponding second indoor leeward flat tubes 83 but also turn back.

(5-3)

The indoor heat exchanger 51 according to one or more embodiments enables appropriate distribution of refrigerant just by connecting the indoor windward flat tubes 81, the first indoor leeward flat tubes 82, and the second indoor leeward flat tubes 83 to the distribution header 70. In particular, the distribution header 70 in one or more embodiments includes members (the tube plate member 71 and the distribution member 72) intended to be shared among the indoor windward flat tubes 81 lined up in the height direction, the first indoor leeward flat tubes 82 lined up in the height direction, and the second indoor leeward flat tubes 83 lined up in the height direction. This eliminates a complicated procedure for forming connections between end portions of the indoor flat tubes 80 in the respective heights by using independent connection pipes such as U-tubes or Y-tubes.

(5-4)

The flat tubes in the indoor heat exchanger 51 according to one or more embodiments are arranged as follows. The indoor windward flat tubes 81 and the first indoor leeward flat tubes 82 do not overlap each other when viewed in the direction of air flow. Similarly, the first indoor leeward flat tubes 82 and the second indoor leeward flat tubes 83 do not overlap each other when viewed in the direction of air flow. This layout enables the air flow created by the indoor fan 52 to come into sufficient contact with the indoor windward flat tubes 81, the first indoor leeward flat tubes 82, and the second indoor leeward flat tubes 83. The efficiency of heat exchange may be enhanced accordingly.

(5-5)

In the indoor heat exchanger 51 according to one or more embodiments, the first indoor leeward flat tube 82 and the second indoor leeward flat tube 83 in the respective columns adjacent to each other in the direction of air flow are connected to the same distribution space 70*x*. A flow of refrigerant coming out of the indoor windward flat tube 81 may thus be distributed to the first indoor leeward flat tube 82 and the second indoor leeward flat tube 83 in different columns.

(5-6)

When the indoor heat exchanger 51 functions as an evaporator for refrigerant, the temperature of air passing by the indoor heat exchanger 51 tends to be lower on the downstream side than on the upstream side in the direction of air flow. Consequently, the first indoor leeward flat tubes 82 on the upstream side in the direction of air flow are more likely to be in contact with high-temperature air than the second indoor leeward flat tubes 83 on the downstream side are.

With consideration given to the tendency, the indoor heat exchanger 51 according to one or more embodiments is configured as follows. Flows of refrigerant turn back while flowing through the indoor heat exchanger 51 functioning as an evaporator. With the first indoor leeward flat tube 82 and the second indoor leeward flat tube 83 being connected to the same distribution space 70*x*, the height position at which the first indoor leeward flat tube 82 is connected to the distribution header 70 is lower than the height position at which the second indoor leeward flat tube 83 is connected to the distribution header 70. When the indoor heat exchanger 51 functions as an evaporator, gas-liquid two-phase refrigerant coming out of the indoor windward flat tube 81 includes refrigerants of different specific gravities, and the refrigerant of a high specific gravity, such as a liquid refrigerant, tends to be led to the first indoor leeward flat tube 82 instead of being led to the second indoor leeward flat tubes 83.

Thus, the gas-liquid two-phase refrigerant coming out of the indoor windward flat tube 81 flows in such a manner that the refrigerant of a high specific gravity may be conducted to the first indoor leeward flat tube 82, by which higher-temperature air passes. The efficiency of heat exchange in the indoor heat exchanger 51 as a whole may be enhanced accordingly.

(5-7)

Refrigerant evaporates and gasifies when flowing through the indoor windward flat tubes 81 of the indoor heat exchanger 51 according to one or more embodiments. The first indoor leeward flat tubes 82 and the second indoor leeward flat tubes 83 are provided to a portion where flows of the refrigerant turn back. The area of flow paths defined by these indoor leeward flat tubes is greater than the area of the flow paths defined by the indoor windward flat tubes 81, and the pressure loss through the indoor heat exchanger 51 may thus be low.

(6) Modifications (6-1) Modification A

The indoor heat exchanger including the indoor flat tubes 80 arranged in three columns adjacent to each other in the direction of air flow has been described so far as an example of the indoor heat exchanger 51 according to the embodiments above.

Figure 14:
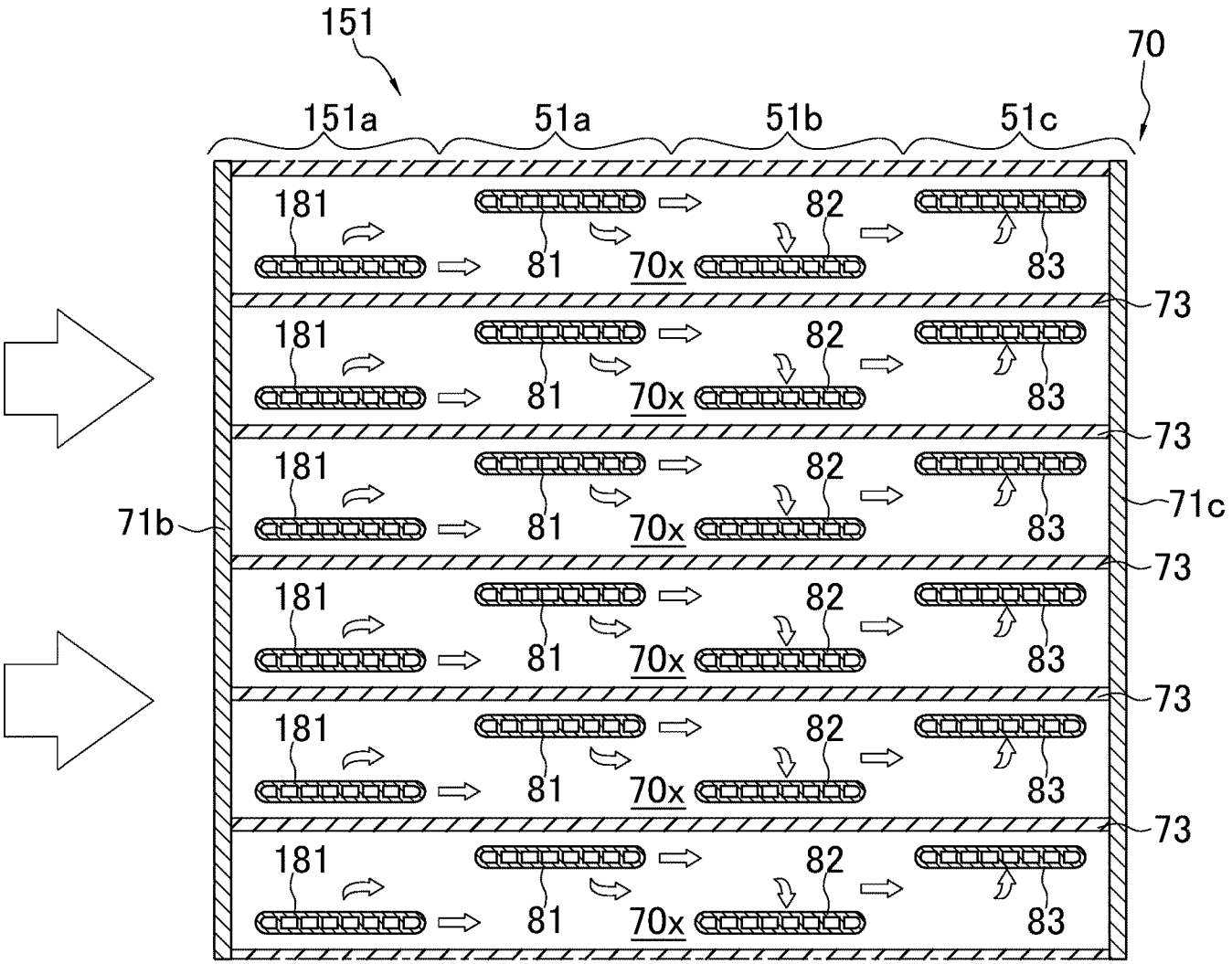
FIG. 14 is a configuration diagram of a distribution header of an indoor heat exchanger according to Modification A and components adjacent to the distribution header, schematically illustrating the layout of the distribution header and the components viewed in a direction in which flow paths in indoor flat tubes extend.

Alternatively, an indoor heat exchanger 151 may be provided. As illustrated in FIG. 14, the indoor flat tubes 80 are arranged in more than three columns, or more specifically, four columns adjacent to each other in the direction of air flow. In other words, the indoor heat exchanger 51 according to the embodiments above may include a windward heat exchange section 151*d*, which includes indoor windward flat tubes 181 on the upstream side of the indoor windward flat tubes 81 in the direction of air flow.

The indoor heat exchanger 151 including the indoor flat tubes 80 arranged in four columns may be configured to cause refrigerant to flow in the following manner. When, for example, the indoor heat exchanger 151 is used as an evaporator, flows of refrigerant coming out of the indoor windward flat tubes 81 and 181 in two respective columns on the upstream side of air flow are distributed to the first indoor leeward flat tube 82 and the second indoor leeward flat tube 83 in two respective columns on the downstream side in the direction of air flow while turning back in the distribution space 70*x*.

Furthermore, the indoor heat exchanger 151 including the indoor flat tubes 80 arranged in four columns may be configured as follows. With the indoor flat tubes 80 being arranged in columns to allow flows of refrigerant to turn back and flow therethrough, each of the indoor flat tubes 80 on the downstream side in the direction of air flow (the first indoor leeward flat tubes 82 in FIG. 14) is in a position lower than the position in the height direction of the corresponding one of the indoor flat tubes 80 (the second indoor leeward flat tube 83 in FIG. 14) further on the downstream side in the direction of air flow. As in the case above, this configuration offers the following advantage: with refrigerants of different specific gravities being included in the gas-liquid two-phase refrigerant, refrigerant of a high specific gravity may be efficiently led to the indoor flat tubes 80 that are located on the windward side to allow refrigerant to turn back and flow therethrough.

(6-2) Modification B

The indoor heat exchanger in which the partition plates 73 of the distribution header 70 lie horizontally to define the distribution spaces 70*x* located in different height positions and extending in the direction of air flow in the respective height positions has been described above as an example of the indoor heat exchanger 51 according to the embodiments above.

Figure 15:
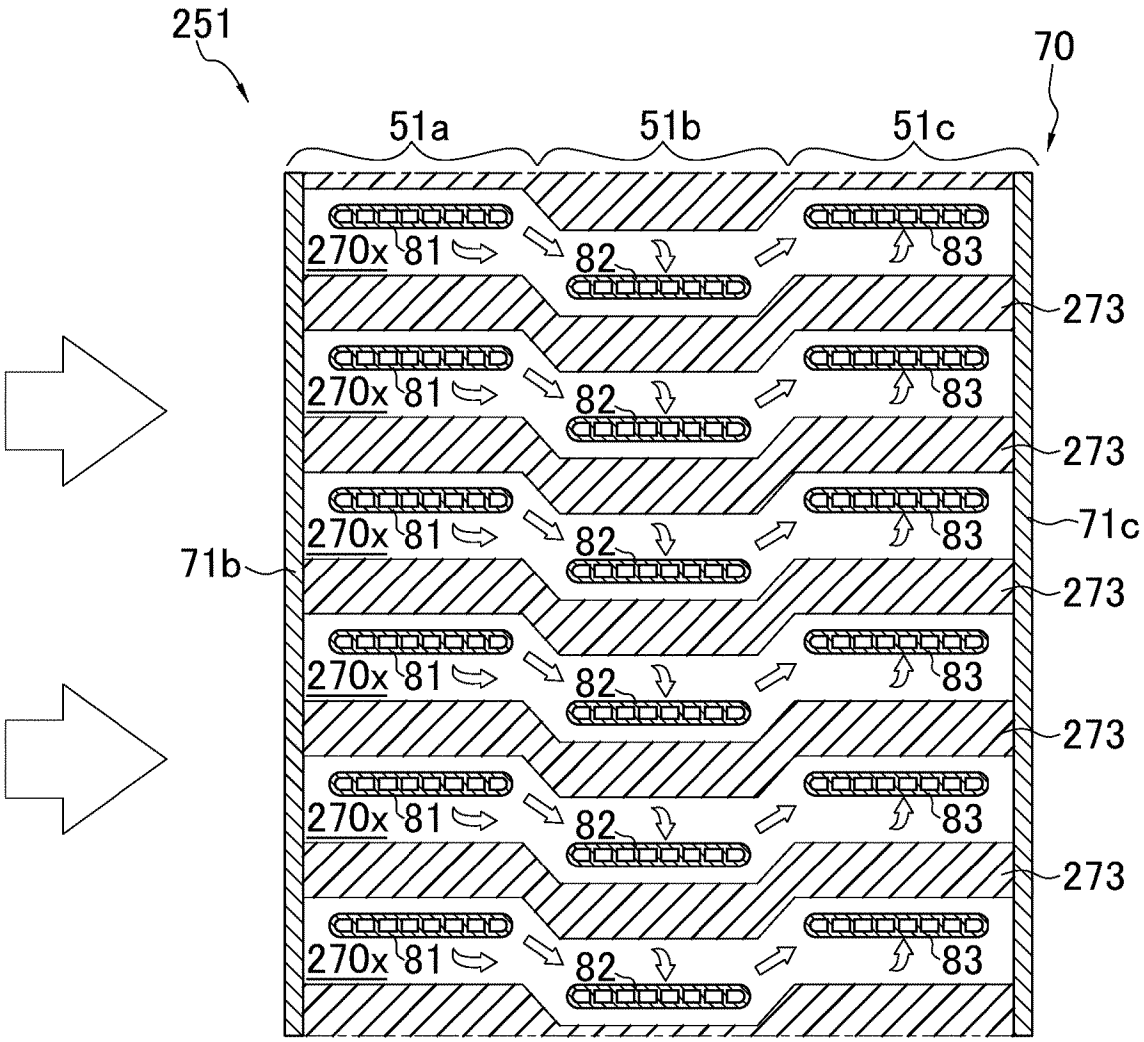
FIG. 15 is a configuration diagram of a distribution header of an indoor heat exchanger according to Modification B and components adjacent to the distribution header, schematically illustrating the layout of the distribution header and the components viewed in a direction in which flow paths in indoor flat tubes extend.

Alternatively, as illustrated in FIG. 15, an indoor heat exchanger 251 configured to have partition plates 273 and distribution spaces 270*x* may be provided. The partition plates 273 of the distribution header 70 are recessed downward in positions corresponding to the positions of the first indoor leeward flat tubes 82 in the direction of air flow. The distribution spaces 270*x* are defined in such a manner that each distribution space 270*x* includes a portion corresponding to the first indoor leeward flat tube 82 and located in a position lower than the position of a portion on the upstream side in the direction of air flow and lower than the position of a portion on the downstream side in the direction of air flow.

The distribution spaces 270*x* shaped as described above in the distribution header 70 of the indoor heat exchanger 251 eliminate or reduce the possibility that flows of refrigerant coming out of the indoor windward flat tubes 81 will be conducted to the second indoor leeward flat tubes 83. Consequently, flows of refrigerant may be distributed in a manner so as to be conducted to the first indoor leeward flat tubes 82 more efficiently. Thus, flows of refrigerant having turned back are more likely to be conducted to flat tubes located on the windward side of the other flat tubes. The efficiency of heat exchange may be further enhanced accordingly.

(6-3) Modification C

The indoor heat exchanger in which the partition plates 73 of the distribution header 70 lie horizontally to define the distribution spaces 70*x* located in different height positions and extending in the direction of air flow in the respective height positions has been described above as an example of the indoor heat exchanger 51 according to the embodiments above.

Figure 16:
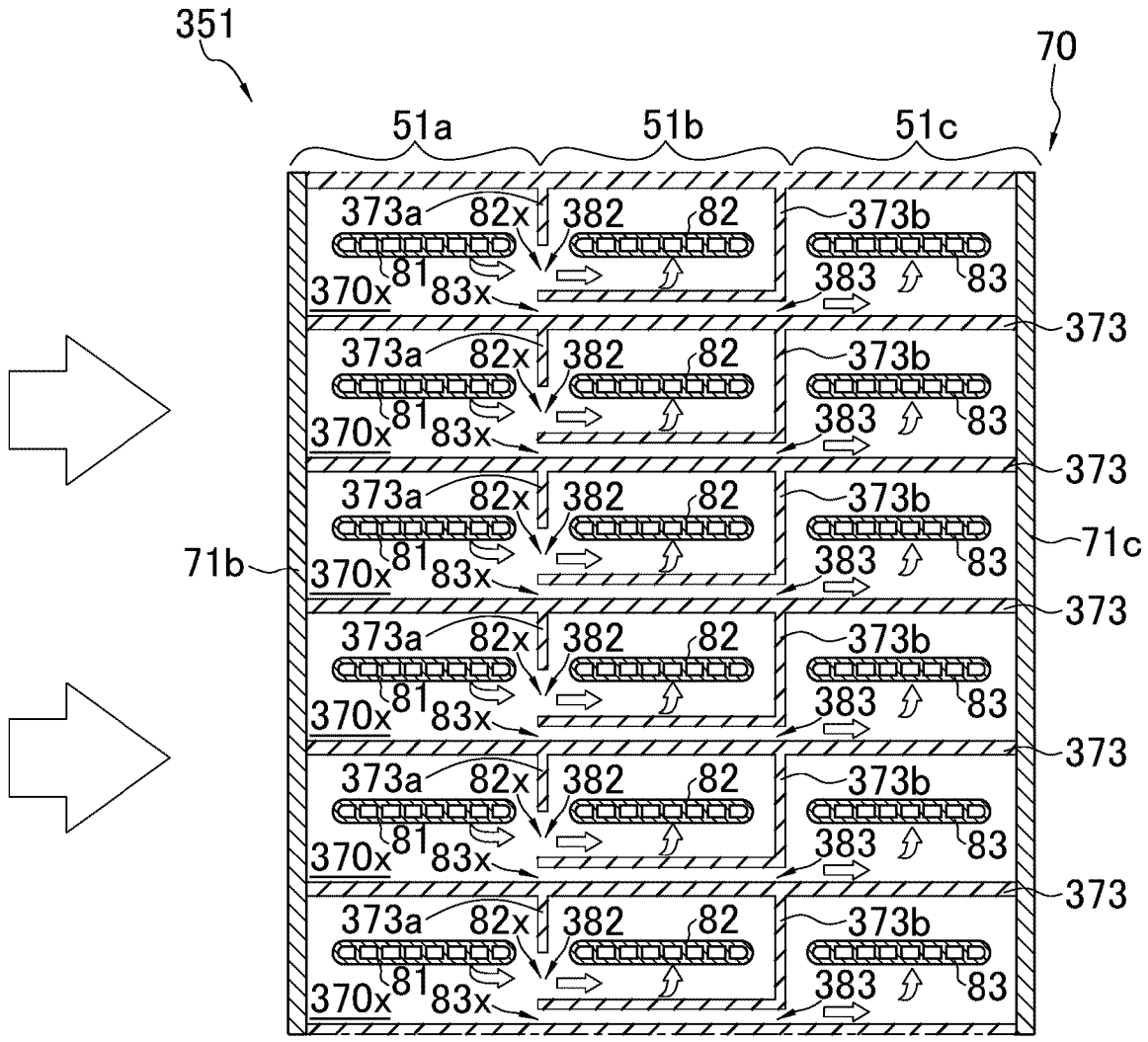
FIG. 16 is a configuration diagram of a distribution header of an indoor heat exchanger according to Modification C and components adjacent to the distribution header, schematically illustrating the layout of the distribution header and the components viewed in a direction in which flow paths in indoor flat tubes extend.

Alternatively, as illustrated in FIG. 16, an indoor heat exchanger 351 configured to have partition plates 373 may be provided. The partition plates 373 are provided in the respective height positions. Each partition plate 373 is configured to have a first flow path 382, through which part of refrigerant coming out of the indoor windward flat tube 81 is led to the first indoor leeward flat tube 82; and a second flow path 383, through which the rest of the refrigerant coming out of the indoor windward flat tube 81 is led to the second indoor leeward flat tube 83 in each distribution spaces 370*x* of the respective height positions. In the example concerned, flat tubes are disposed in such a manner that in each height position, the corresponding one of the indoor windward flat tubes 81, the corresponding one of first indoor leeward flat tubes 82, and the corresponding one of the second indoor leeward flat tubes 83 overlap each other in the direction of air flow.

Each partition plate 373 includes a first guide 373*a* and a second guide 373*b*. The first guide 373*a* extends downward from a region being part of the lower face of the partition plate 373 and located between the indoor windward flat tube 81 and the first indoor leeward flat tube 82. The first guide 373*a* extends to about the height position of the indoor windward flat tube 81 and the first indoor leeward flat tube 82. The second guide 373*b* extends downward from a region being part of the lower face of the partition plate 373 and located between the first indoor leeward flat tube 82 and the second indoor leeward flat tube 83. The second guide 373*b* extends to a position lower than the position of the first indoor leeward flat tube 82, lies below and along the first indoor leeward flat tube 82, and ends short of the indoor windward flat tube 81. The first guide 373*a* and the second guide 373*b* extend from the tube plate 71*a* to the turnback wall 72*a* of the distribution header 70.

The first flow path 382 is defined between a lower end of the first guide 373*a* and an end portion of the second guide 373*b* on the upstream side in the direction of air flow. The first flow path 382 has a first inlet 82*x*, which is provided in the upstream-side end portion of the first flow path 382. The second flow path 383 is defined between a portion being part of the second guide 373*b* and lying below and along the first indoor leeward flat tube 82 and the upper face of another partition plate 373 located below the partition plate 373 concerned. The second flow path 383 has a second inlet 83*x*, which is provided in an upstream-side end portion of the second flow path 383.

Furthermore, the first inlet 82*x*, through which a flow of refrigerant coming out of the indoor windward flat tube 81 and directed to the first indoor leeward flat tube 82 passes, is wider than the second inlet 83*x*, through which a flow of refrigerant coming out of the indoor windward flat tube 81 and directed to the second indoor leeward flat tube 83 passes. Owing to this configuration, a flow of refrigerant coming out of the indoor windward flat tube 81 tends to pass through a wider inlet, namely, the first inlet 82*x* instead of passing through a narrower inlet, namely, the second inlet 83*x*. Flows of refrigerant are thus conducted to the first indoor leeward flat tubes 82 more efficiently, and the efficiency of heat exchange may be enhanced accordingly.

The indoor heat exchanger in which the indoor flat tubes 80 in different columns are in the same height position has been described so far as an example of the indoor heat exchanger 351 according to the modification C. However, it is not required that these indoor flat tubes 80 be in the same height position. The indoor heat exchanger may include a portion in which the indoor flat tube 80 do not overlap each other when viewed in the direction of air flow.

(6-4) Modification D

The indoor heat exchanger in which the partition plates 73 of the distribution header 70 lie horizontally to define the distribution spaces 70*x* located in different height positions and extending in the direction of air flow in the respective height positions has been described above as an example of the indoor heat exchanger 51 according to the embodiments above.

Figure 17:
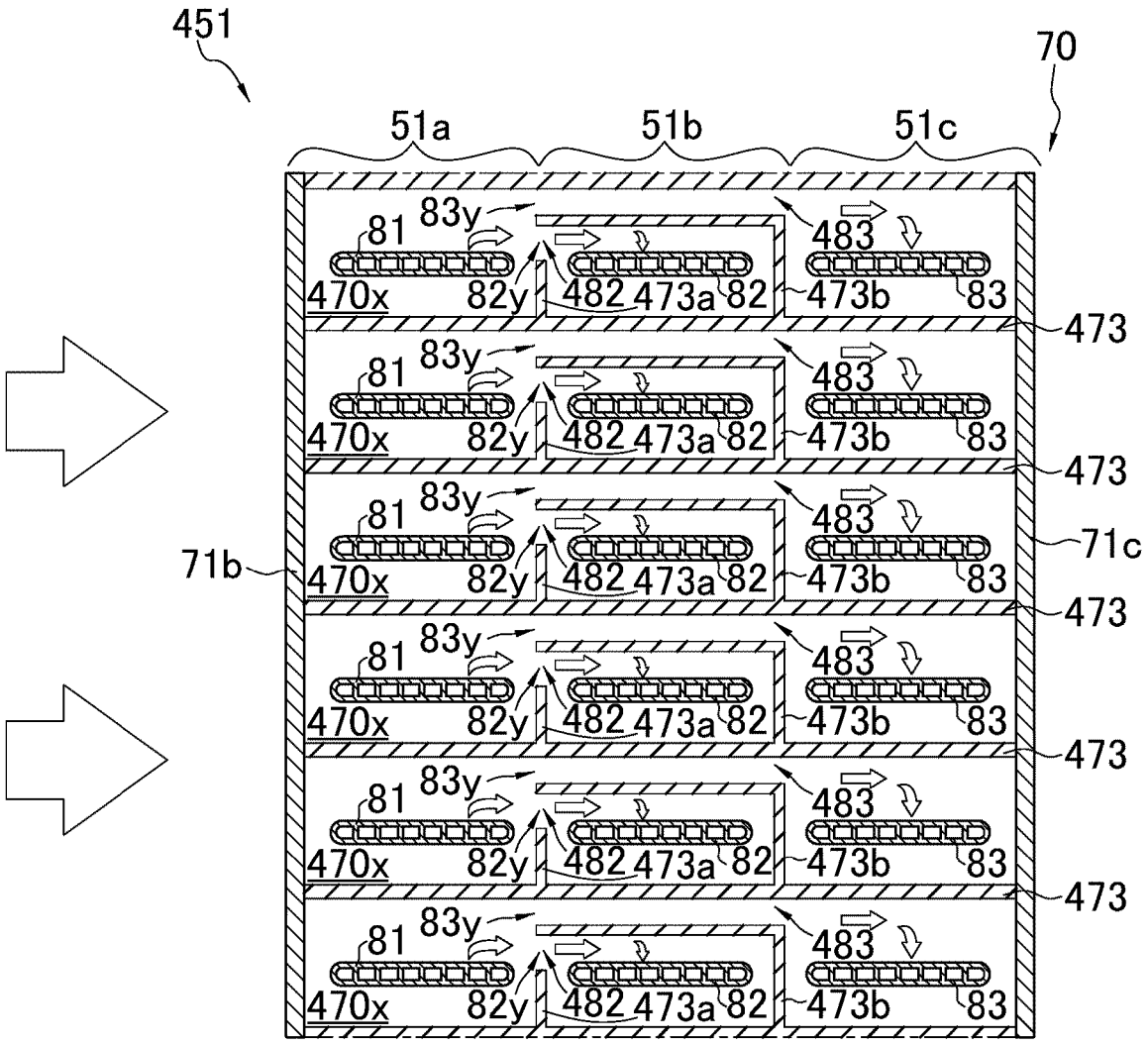
FIG. 17 is a configuration diagram of a distribution header of an indoor heat exchanger according to Modification D and components adjacent to the distribution header, schematically illustrating the layout of the distribution header and the components viewed in a direction in which flow paths in indoor flat tubes extend.

Alternatively, as illustrated in FIG. 17, an indoor heat exchanger 451 configured to have partition plates 473 may be provided. The partition plates 473 are provided in the respective height positions. Each partition plate 473 is configured to have a third flow path 482, through which part of refrigerant coming out of the indoor windward flat tube 81 is led to the first indoor leeward flat tube 82; and a fourth flow path 483, through which the rest of the refrigerant coming out of the indoor windward flat tube 81 is led to the second indoor leeward flat tube 83 in each distribution spaces 470*x* of the respective height positions. In the example concerned, flat tubes are disposed in such a manner that in each height position, the corresponding one of the indoor windward flat tubes 81, the corresponding one of the first indoor leeward flat tubes 82, and the corresponding one of the second indoor leeward flat tubes 83 overlap each other in the direction of air flow.

Each partition plate 473 includes a third guide 473*a* and a fourth guide 473*b*. The third guide 473*a* extends upward from a region being part of the upper face of the partition plate 473 and located between the indoor windward flat tube 81 and the first indoor leeward flat tube 82. The third guide 473*a* extends to about the height position of the indoor windward flat tube 81 and the first indoor leeward flat tube 82. The fourth guide 473*b* extends upward from a region being part of the upper face of the partition plate 473 and located between the first indoor leeward flat tube 82 and the second indoor leeward flat tube 83. The fourth guide 473*b* extends to a position higher than the position of the first indoor leeward flat tube 82, lies above and along the first indoor leeward flat tube 82, and ends short of the indoor windward flat tube 81. The third guide 473*a* and the fourth guide 473*b* extend from the tube plate 71*a* to the turnback wall 72*a* of the distribution header 70.

The third flow path 482 is defined between an upper end of the third guide 473*a* and an end portion of the fourth guide 473*b* on the upstream side in the direction of air flow. The third flow path 482 has a third inlet 82*y*, which is provided in the upstream-side end portion of the third flow path 482. The fourth flow path 483 is defined between a portion being part of the fourth guide 473*b* and lying above and along the first indoor leeward flat tube 82 and the lower face of another partition plate 473 located above the partition plate 473 concerned. The fourth flow path 483 has a fourth inlet 83*y*, which is provided in an upstream-side end portion of the fourth flow path 483.

Furthermore, the third inlet 82*y*, through which a flow refrigerant coming out of the indoor windward flat tube 81 and directed to the first indoor leeward flat tube 82 passes, is in the height position lower than the height position of the fourth inlet 83*y*, through which a flow of refrigerant coming out of the indoor windward flat tube 81 and directed to the second indoor leeward flat tube 83 passes. Gas-liquid two-phase refrigerant coming out of the indoor windward flat tube 81 includes refrigerants of different specific gravities. Owing to the configuration above, the refrigerant of a high specific gravity, such as a liquid refrigerant, tends to pass through a lower inlet, namely, the third inlet 82*y* instead of passing through a higher inlet, namely, the fourth inlet 83*y*. Flows of refrigerant are thus conducted to the first indoor leeward flat tubes 82 more efficiently, and the efficiency of heat exchange may be enhanced accordingly.

The indoor heat exchanger in which the indoor flat tubes 80 in different columns are in the same height position has been described so far as an example of the indoor heat exchanger 451 according to the modification D. However, it is not required that these indoor flat tubes 80 be in the same height position. The indoor heat exchanger may include a portion in which the indoor flat tube 80 do not overlap each other when viewed in the direction of air flow.

The feature of the modification C may be combined with the feature of the modification D. With refrigerants of different specific gravities being included in gas-liquid two-phase refrigerant coming out of the indoor windward flat tube 81, the refrigerant of a higher specific gravity, such as a liquid refrigerant, may be led to the first indoor leeward flat tube 82 more efficiently, owing to the third inlet 82*y* being in a position lower than the position of the fourth inlet 83*y* and being wider than the fourth inlet 83*y*. In this case, the third inlet 82*y* and the fourth inlet 83*y* may be shaped in such a manner that the third inlet 82*y* in up-and-down directions is wider than the fourth inlet 83*y* in the up-and-down directions when viewed in section as in FIG. 17. Alternatively, the gap between the tube plate 71*a* and the turnback wall 72*a* may be partially narrowed or an intervening member may be disposed between the tube plate 71*a* and the turnback wall 72*a*. The third inlet 82*y* in up-and-down direction may thus be wider than the fourth inlet 83*y* in the up-and-down directions when viewed in a direction orthogonal to the sheet of FIG. 17, which is a sectional view.

(6-5) Modification E

The indoor heat exchanger 51 according to the embodiments above has been described so far, with no consideration given to the wind speed distribution provided by the air flow from the indoor fan 52, especially in use environments.

Figure 18:
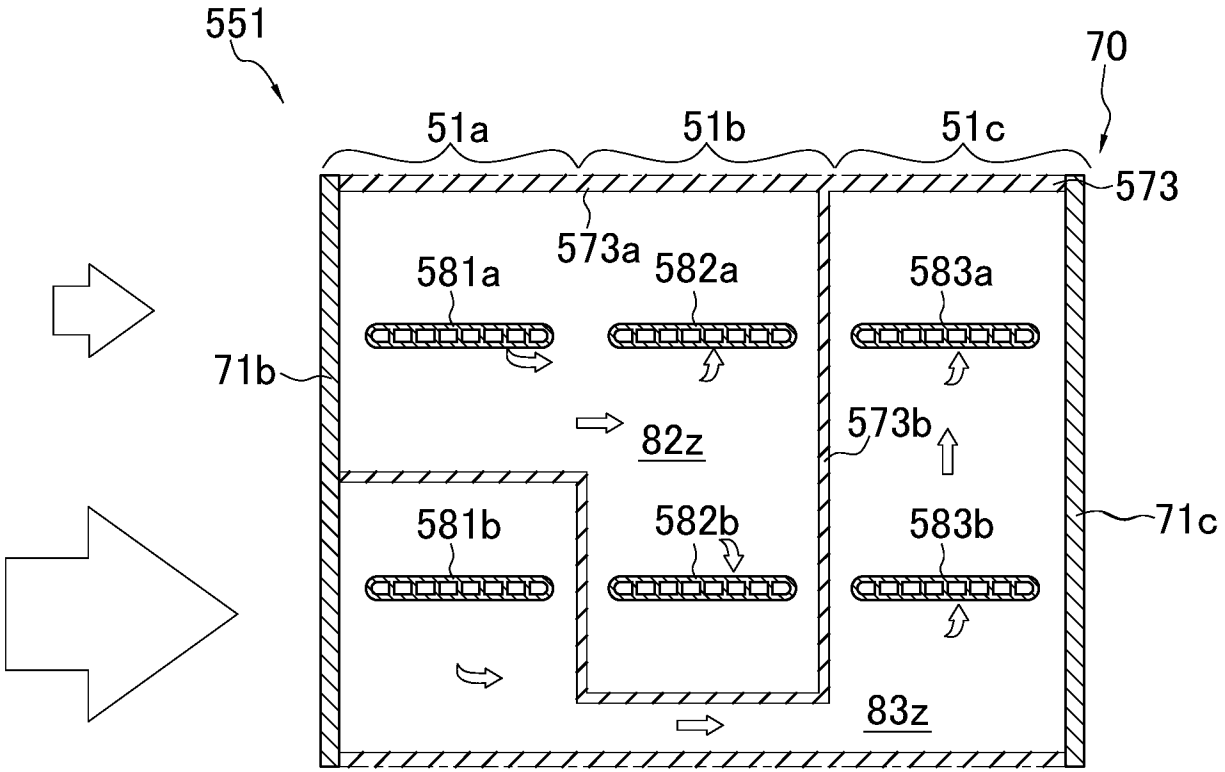
FIG. 18 is a configuration diagram of a distribution header of an indoor heat exchanger according to Modification E and components adjacent to the distribution header, schematically illustrating the layout of the distribution header and the components viewed in a direction in which flow paths in indoor flat tubes extend.

Alternatively, an indoor heat exchanger 551, which is configured as illustrated in FIG. 18, may be provided.

The indoor heat exchanger 551 includes: windward flat tubes 581*a* and 581*b*, which constitute the windward heat exchange section 51*a* on the upstream side in the direction of air flow; second leeward flat tubes 583*a* and 583*b*, which constitute the second leeward heat exchange section 51*c* on the downstream side in the direction of air flow; and first leeward flat tubes 582*a* and 582*b*, which constitute the first leeward heat exchange section 51*b* located between the windward flat tube 581*a* and the second leeward flat tube 583*a* and between the windward flat tube 581*b* and the second leeward flat tube 583*b* in the direction of air flow. The windward flat tubes 581*a* and 581*b* include an upper windward flat tube 581*a* and a lower windward flat tube 581*b* arranged in this order from top to bottom in the height direction. The first leeward flat tubes 582*a* and 582*b* include an upper first leeward flat tube 582*a* and a lower first leeward flat tube 582*b* arranged in this order from top to bottom in the height direction. The second leeward flat tube 583*a* and 583*b* include an upper second leeward flat tube 583*a* and a lower second leeward flat tube 583*b* arranged in this order from top to bottom in the height direction.

Furthermore, the distribution header 70 includes a partition plate 573, which includes a main partition portion 573*a* and a sub-partition portion 573*b*. The main partition portion 573*a* lies horizontally in a manner so as to vertically partition off the indoor flat tubes 80 (in the example concerned, two indoor flat tubes 80) adjacent to each other in the up-and-down directions, or more specifically, the upper windward flat tube 581*a* and the lower windward flat tube 581*b*, the upper first leeward flat tube 582*a* and the lower first leeward flat tube 582*b*, and the upper second leeward flat tube 583*a* and the lower second leeward flat tube 583*b*.

The sub-partition portion 573*b* extends downward from a region being part of the lower surface of the main partition portion 573*a* and located between the upper first leeward flat tube 582*a* and the upper second leeward flat tube 583*a*. The sub-partition portion 573*b* extends to a position lower than the position of the lower first leeward flat tube 582*b* and extends windward in manner so as to lie below and along the lower first leeward flat tube 582*b*. The sub-partition portion 573*b* further extends upward between the lower windward flat tube 581*b* and the lower first leeward flat tube 582*b* and extends windward to the inner side wall 71*b* in a manner so as to lie above the lower windward flat tube 581*b*. The main partition portion 573*a* and the sub-partition portion 573*b* extend from the tube plate 71*a* side to the turnback wall 72*a*.

The main partition portion 573*a* and the sub-partition portion 573*b* mentioned above partition the distribution header 70 into a first distribution space 82*z* and a second distribution space 83*z*. The upper windward flat tube 581*a*, the upper first leeward flat tube 582*a*, and the lower first leeward flat tube 582*b* are placed in the first distribution space 82*z*, and the lower windward flat tube 581*b*, the upper second leeward flat tube 583*a*, and the lower second leeward flat tube 583*b* are placed in the second distribution space 83*z*. The number of the indoor flat tubes 80 (two in the example concerned, where the upper first leeward flat tube 582*a* and the lower first leeward flat tube 582*b* are provided) in the first leeward heat exchange section 51*b* connected to the first distribution space 82*z*, to which the upper windward flat tube 581*a* is connected, is greater than the number of the indoor flat tubes 80 (zero in the example concerned) in the first leeward heat exchange section 51*b* connected to the second distribution space 83*z*, to which the lower windward flat tube 581*b* is connected.

The indoor heat exchanger 551 according to the modification E is to be used in the environment where air flow is supplied in such a manner that the wind speed is lower in the upper portion and higher in the lower portion as denoted by arrows of different sizes in FIG. 18. The air flow with the wind speed distribution is not limited. The wind speed distribution may be due the presence or absence of something that offers air passage resistance in the middle of air flow or may be due to varying distances from the indoor fan 52.

In the indoor heat exchanger 551 configured as described above, the speed of the air flow around the upper windward flat tube 581*a* is lower than the speed of the air flow around the lower windward flat tube 581*b*. The efficiency of heat exchange may thus be lower in the upper windward flat tube 581*a* than in the lower windward flat tube 581*b*. When, for example, the indoor heat exchanger 551 is used as an evaporator for refrigerant, the degree of evaporation of a flow of refrigerant through the upper windward flat tube 581*a* may not be as sufficient as the degree of evaporation of a flow of refrigerant through the lower windward flat tube 581*b*, and a large proportion of refrigerant coming out of the upper windward flat tube 581*a* will presumably be liquid refrigerant.

As a workaround, the indoor heat exchanger 551 has the following feature. When, for example, the indoor heat exchanger 551 is used as an evaporator for refrigerant, a flow of refrigerant coming out of the upper windward flat tube 581*a* is distributed to the upper first leeward flat tube 582*a* and the lower first leeward flat tube 582*b* while passing through the first distribution space 82*z*, and a flow of refrigerant coming out of the lower windward flat tube 581*b* is distributed to the upper second leeward flat tube 583*a* and the lower second leeward flat tube 583*b* while passing through the second distribution space 83*z*. As for the air flow passing by the indoor heat exchanger 551 functioning as an evaporator, the temperature of air passing by the upper first leeward flat tube 582*a* and the lower first leeward flat tube 582*b* tends to be higher than the temperature of air passing by the upper second leeward flat tube 583*a* and the lower second leeward flat tube 583*b*. The degree of evaporation of a flow of refrigerant through the upper windward flat tube 581*a*, which is in a position where the wind speed is relatively small, may be insufficient, and as a result, a large proportion of refrigerant coming out of the upper windward flat tube 581*a* will presumably be liquid refrigerant; nevertheless, the relevant refrigerant will be able to evaporate sufficiently while being conducted through the upper first leeward flat tube 582*a* and the lower first leeward flat tube 582*b* supplied with higher-temperature air. Meanwhile, the degree of evaporation of a flow of refrigerant through the lower windward flat tube 581*b*, which is in a position where the wind speed is relatively high, may be sufficient, and as a result, a small proportion of refrigerant coming out of the lower windward flat tube 581*b* will presumably be liquid refrigerant. Thus, there is no disadvantage of conducting the relevant refrigerant through the upper second leeward flat tube 583*a* and the lower second leeward flat tube 583*b* supplied with relatively low-temperature air.

Consequently, flows of refrigerant respectively coming out of the upper first leeward flat tube 582*a* and the lower first leeward flat tube 582*b* through the first distribution space 82*z* and flows of refrigerant respectively coming out of the upper second leeward flat tube 583*a* and the lower second leeward flat tube 583*b* through the second distribution space 83*z* may thus fall into similar states, irrespective of any difference between the speed of air passing by the upper windward flat tube 581*a* and the speed of air passing by the lower windward flat tube 581*b*.

Although the first distribution space 82*z* and the second distribution space 83*z* described above are included in the distribution header 70, it is not required that this configuration be adopted in all of the height positions in the indoor heat exchanger. For example, the configuration concerned may be adopted in only part of the indoor heat exchanger, or more specifically, an upper or lower end where the wind speed distribution is found.

(6-6) Modification F

According to the embodiments above, the indoor heat exchanger 51 includes the indoor flat tubes 80 arranged in columns adjacent to each other in the direction of air flow and that the outdoor heat exchanger 11 includes the outdoor flat tubes 90 arranged in a column, which stands alone in the direction of air flow.

Alternatively, as with the flat tubes in the indoor heat exchanger 51, the outdoor flat tubes 90 in the outdoor heat exchanger 11 may be arranged in columns adjacent to each other in the direction of air flow.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 air conditioner
2 outdoor unit
3 indoor unit

11 outdoor heat exchanger
51 indoor heat exchanger
51*a* windward heat exchange section
51*b* first leeward heat exchange section
51*c* second leeward heat exchange section
52 indoor fan (fan)
55 indoor flat tube
55*c* flow path
56 liquid-side header
57 first gas-side header
58 second gas-side header
60 indoor fin
64 indoor communicating portion
70 distribution header (header, space formation member)
70*x* distribution space
71 tube plate member
72 distribution member
73 partition plate (space formation member)
80 indoor flat tube
81 indoor windward flat tube (upstream-side flat tube)
82 first indoor leeward flat tube (downstream-side flat tube)
82*y* third inlet
82*z* first distribution space
83 second indoor leeward flat tube (downstream-side flat tube)
83*y* fourth inlet
83*z* second distribution space
90 outdoor flat tube
90*c* flow path
91 outdoor fin
151 indoor heat exchanger
181 indoor windward flat tube (upstream-side flat tube)
251 indoor heat exchanger
270*x* distribution space
273 partition plate (space formation member)
351 indoor heat exchanger
370*x* distribution space
373 partition plate (space formation member)
382 first flow path (first communicating channel)
383 second flow path (second communicating channel)
451 indoor heat exchanger
470*x* distribution space
473 partition plate (space formation member)
482 third flow path (first communicating channel)
483 fourth flow path (second communicating channel)
551 indoor heat exchanger
573*a* main partition plate (space formation member)
573*b* sub-partition plate (space formation member)
581*a* upper windward flat tube (first upstream-side flat tube)
581*b* lower windward flat tube (second upstream-side flat tube)
582*a* upper first leeward flat tube (downstream-side flat tube)
582*b* lower first leeward flat tube (downstream-side flat tube)
583*a* upper second leeward flat tube (downstream-side flat tube)
583*b* lower second leeward flat tube (downstream-side flat tube)

PATENT LITERATURE

PTL 1: International Publication No. 2010/146852

The invention claimed is:

1. A heat exchanger that exchanges heat between refrigerant flowing inside and air flowing outside, the heat exchanger comprising:

an upper upstream-side flat tube;

a first upper downstream-side flat tube downstream of the upper upstream-side flat tube in a direction of air flow; and a second upper downstream-side flat tube downstream of the first upper downstream-side flat tube in the direction of the air flow;

a lower upstream-side flat tube below the upper upstream-side flat tube such that a flat portion of the lower upstream-side flat tube faces a flat portion of the upper upstream-side flat tube;

a first lower downstream-side flat tube downstream of the lower upstream-side flat tube in the direction of the air flow such that a flat portion of the first lower downstream-side flat tube faces a flat portion of the first upper downstream-side flat tube;

a second lower downstream-side flat tube downstream of the first lower downstream-side flat tube in the direction of the air flow such that a flat portion of the second lower downstream-side flat tube faces a flat portion of the second upper downstream-side flat tube; and a space formation member that defines:

an upper distribution space in which the refrigerant coming out of the upper upstream-side flat tube is distributed to the first upper downstream-side flat tube and the second upper downstream-side flat tube, and a lower distribution space in which the refrigerant coming out of the lower upstream-side flat tube is distributed to the first lower downstream-side flat tube and the second lower downstream-side flat tube, wherein the space formation member comprises a partition plate that separates the upper distribution space from the lower distribution space.

2. The heat exchanger according to claim 1, wherein the upper distribution space turns back the refrigerant coming out of the upper upstream-side flat tube and leads the refrigerant to the first upper downstream-side flat tube and the second upper downstream-side flat tube, and the lower distribution space turns back the refrigerant coming out of the lower upstream-side flat tube and leads the refrigerant to the first lower downstream-side flat tube and the second lower downstream-side flat tube.

3. The heat exchanger according to claim 1, further comprising:

a header that comprises the space formation member, wherein the upper distribution space and the lower distribution space are inside the header, and all of the upper upstream-side flat tube, the lower upstream-side flat tube, the first upper downstream-side flat tube, the second upper downstream-side flat tube, the first lower downstream-side flat tube, and the second lower downstream-side flat tube are connected to the header.

4. The heat exchanger according to claim 1, wherein the heat exchanger further comprises:

a portion in which flat tubes connected to the upper distribution space do not overlap each other when viewed in the direction of the air flow; and a portion in which flat tubes connected to the lower distribution space do not overlap each other when viewed in the direction of the air flow.

5. The heat exchanger according to claim 1, wherein a first communicating channel and a second communicating channel are disposed in the upper distribution space, the first communicating channel leads the refrigerant coming out of the upper upstream-side flat tube to the first upper downstream-side flat tube, the second communicating channel leads the refrigerant coming out of the upper upstream-side flat tube to the second upper downstream-side flat tube, a flow path defined by the first communicating channel is wider than a flow path defined by the second communicating channel, a third communicating channel and a fourth communicating channel are disposed in the lower distribution space, the third communicating channel leads the refrigerant coming out of the lower upstream-side flat tube to the first lower downstream-side flat tube, the fourth communicating channel leads the refrigerant coming out of the lower upstream-side flat tube to the second lower downstream-side flat tube, and a flow path defined by the third communicating channel is wider than a flow path defined by the fourth communicating channel.

6. The heat exchanger according to claim 1, wherein a first communicating channel and a second communicating channel are disposed in the upper distribution space, the first communicating channel leads the refrigerant coming out of the upper upstream-side flat tube to the first upper downstream-side flat tube, the second communicating channel leads the refrigerant coming out of the upper upstream-side flat tube to the second upper downstream-side flat tube, an inlet of the first communicating channel is disposed lower in a direction of gravity than an inlet of the second communicating channel, a third communicating channel and a fourth communicating channel are disposed in the lower distribution space, the third communicating channel leads the refrigerant coming out of the lower upstream-side flat tube to the first lower downstream-side flat tube, the fourth communicating channel leads the refrigerant coming out of the lower upstream-side flat tube to the second lower downstream-side flat tube, and an inlet of the third communicating channel is disposed lower in the direction of gravity than an inlet of the fourth communicating channel.

7. The heat exchanger according to claim 1, wherein the first upper downstream-side flat tube is disposed lower in a direction of gravity than the second upper downstream-side flat tube, and the first lower downstream-side flat tube is disposed lower in the direction of gravity than the second lower downstream-side flat tube.

8. An air conditioner comprising:

the heat exchanger according to claim 1; and a fan that supplies the air flow to the heat exchanger.

* * * * *